US008770700B2

(12) United States Patent
Samoto et al.

(10) Patent No.: US 8,770,700 B2
(45) Date of Patent: Jul. 8, 2014

(54) IMAGE RECORDING APPARATUS AND CONTROL METHOD FOR CONTROLLING IMAGE RECORDING APPARATUS

(75) Inventors: Kenji Samoto, Nagoya (JP); Yuji Koga, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 476 days.

(21) Appl. No.: 13/072,284

(22) Filed: Mar. 25, 2011

(65) Prior Publication Data

US 2011/0311291 A1 Dec. 22, 2011

(30) Foreign Application Priority Data

Jun. 17, 2010 (JP) ..... 2010-138807

(51) Int. Cl.
*B41J 2/01* (2006.01)

(52) U.S. Cl.
USPC ..... 347/16; 347/104

(58) Field of Classification Search
USPC ..... 347/16, 108, 104; 400/578; 271/122, 271/259, 265.01
See application file for complete search history.

(56) References Cited

U.S. PATENT DOCUMENTS

| | | | | |
|---|---|---|---|---|
| 2006/0024113 | A1 * | 2/2006 | Saito et al. | 400/578 |
| 2008/0012206 | A1 * | 1/2008 | Koga et al. | 271/122 |
| 2008/0179824 | A1 * | 7/2008 | Koyama | 271/259 |
| 2009/0035018 | A1 | 2/2009 | Koga | |
| 2009/0035019 | A1 | 2/2009 | Koga | |
| 2009/0073248 | A1 * | 3/2009 | Silverbrook et al. | 347/108 |
| 2009/0166964 | A1 * | 7/2009 | Fukasawa | 271/265.01 |

FOREIGN PATENT DOCUMENTS

| | | |
|---|---|---|
| JP | 2006-036490 A | 2/2006 |
| JP | 2009-034847 A | 2/2009 |

* cited by examiner

*Primary Examiner* — Manish S Shah
*Assistant Examiner* — Yaovi Ameh
(74) *Attorney, Agent, or Firm* — Baker Botts L.L.P.

(57) ABSTRACT

An image recording apparatus including: a transport passage which has a curved portion; a first transport roller pair which is disposed at the curved portion; a second transport roller pair which is located downstream of the first transport roller pair; and a controller which selectively executes a first recording mode or a second recording mode, wherein: in the first recording mode, the controller stops driving of the first transport roller pair for a predetermined period in an interposed state in which a recording medium is interposed by both of the first and second transport roller pairs, the controller controls a second driving motor intermittently and controls a recording head to discharge ink during a stopping period in which the second transport roller pair is stopped; and in the second recording mode, the controller controls first and second driving motors in synchronization in the interposed state.

11 Claims, 22 Drawing Sheets

IMAGE RECORDING APPARATUS AND CONTROL METHOD FOR CONTROLLING IMAGE RECORDING APPARATUS

CROSS REFERENCE TO RELATED APPLICATION

The present application claims priority from Japanese Patent Application No. 2010-138807, filed on Jun. 17, 2010, the disclosure of which is incorporated herein by reference in its entirety.

BACKGROUND OF THE INVENTION

1. Field of the Invention

The present invention relates to an image recording apparatus which records an image by transporting a sheet-shaped recording medium and discharging an ink or inks onto the transported recording medium, and a control method for controlling the image recording apparatus.

2. Description of the Related Art

The image recording apparatus has been hitherto provided, for example, by printers, copying machines, and multifunction machines having the printing, scanning, copying, and facsimile functions.

Such an image recording apparatus includes an apparatus based on the so-called ink jet recording system provided with a placing section on which a sheet-shaped recording medium such as the recording paper or the like is placed, a feed roller which feeds the recording medium from the placing section, a first driving motor which drives the feed roller, a main transport roller pair which interposes and transports the recording medium fed by the feed roller, a second driving motor which drives the main transport roller pair, a recording head which records an image by discharging an ink or inks onto the recording medium transported by the main transport roller pair, and a control unit which controls the ink discharge to be performed by the recording head, the driving of the first driving motor, and the driving of the second driving motor. The image recording apparatus based on the ink-jet recording system is provided with, for example, a detecting section such as an encoder or the like in which the output is changed depending on the rotation amount of the main transport roller pair. The control unit described above performs the line feed by judging the feed amount of the recording medium fed from the main transport roller pair in accordance with the change of the output of the encoder.

Another image recording apparatus is known, in which a plurality of driving sections such as a feed roller and the like are driven by one driving motor by using a driving force transmitting/switching mechanism.

Still another image recording apparatus is known, in which a placing section is accommodated in a lower portion of a casing, a recording head is arranged over or above the placing section, and a curved section is provided at a transport passage for transporting a recording medium in order to realize a compact size.

The image recording apparatus can be made compact by providing the curved section at the transport passage. However, the recording medium, which is transported, receives the frictional force at the curved section. Therefore, if the radius of curvature of the curved section is too small, then the frictional force is excessively increased, and the relationship between the output change of the encoder described above and the feed amount of the recording medium from the main transport roller pair is disordered. The position accuracy of the image recording is lowered.

SUMMARY OF THE INVENTION

Taking the foregoing circumstances into consideration, the present teaching provides several aspects, an object of which is to enable the high speed image recording and the highly accurate image recording while suppressing the increase in the cost and suppress the increase in the electric power consumption amount in an image recording apparatus having a curved section provided at a transport passage.

According to a first aspect of the present teaching, there is provided an image recording apparatus which records an image on a sheet-shaped recording medium, the image recording apparatus including: a first placing section on which the recording medium is placed; a transport passage via which the recording media is transported and which has a curved portion; a first feed roller which feeds the recording medium placed on the first placing section to the transport passage; a first transport roller pair which is disposed at the curved portion and which interposes and transports the recording medium; a second transport roller pair which is located downstream of the first transport roller pair in a transport direction of the recording medium and which interposes and transports the recording medium; a recording head which discharges an ink onto the recording medium transported by the second transport roller pair; a first driving motor which is rotatable in forward and reverse directions; a first driving force transmitting section which transmits, to the first feed roller, a driving force of the first driving motor rotating in the forward direction and which transmits, to the first transport roller pair, a driving force of the first driving motor rotating in the reverse direction; a second driving motor which drives the second transport roller pair; and a controller which controls the first driving motor and the second driving motor, which controls the recording head to discharge the ink therefrom, and which selectively executes a first recording mode or a second recording mode, wherein the controller controls the first driving motor to transport the recording medium in the transport direction and to provide an interposed state in which the recording medium is interposed by both of the first and second transport roller pairs; in the first recording mode, the controller stops driving of the first transport roller pair for a predetermined period of time in the interposed state to transport the recording medium by the second transport roller pair, controls the second driving motor intermittently to drive and stop the second transport roller pair and controls the recording head to discharge the ink therefrom toward the recording medium during a stopping period in which the second transport roller pair is stopped; and in the second recording mode, the controller controls the first and second driving motors in synchronization in the interposed state to transport the recording medium by the first and second transport roller pairs, controls the first and second driving motors intermittently to drive and stop the first and second transport roller pairs and controls the recording head to discharge the ink therefrom toward the recording medium during a stopping period in which the first and second transport roller pairs are stopped.

According to a second aspect of the present teaching, there is provided a control method for controlling the image recording apparatus as defined in the first aspect, the control method including: determining which one of the first recording mode and the second recording mode is to be executed; driving the first feed roller by rotating the first driving motor in the forward direction to feed the recording medium, placed on the first placing section, to the transport passage; driving the first transport roller pair by rotating the first driving motor in the reverse direction to transport the recording medium in the transport direction and to provide the interposed state; in the first recording mode, stopping the driving of the first transport roller pair for the predetermined period of time in the interposed state, driving the second transport roller pair to transport the recording medium, driving the second driving motor intermittently to drive and stop the second transport roller pair and discharging the ink toward the recording medium during a stopping period in which the second transport roller pair is stopped; and in the second recording mode, driving the first and second driving motors in synchronization in the interposed state to transport the recording medium by the first and second transport roller pairs, driving the first and second driving motors intermittently to drive and stop the first and second transport roller pairs and discharging the ink toward the recording medium during a stopping period in which the first and second transport roller pairs are stopped.

According to the aspects of the present teaching, it is possible to perform the high speed image recording and the highly accurate image recording while suppressing the increase in the cost and suppress the increase in the electric power consumption amount in the image recording apparatus having the curved section provided at the transport passage.

DESCRIPTION OF THE PREFERRED EMBODIMENTS

Figure 10A:
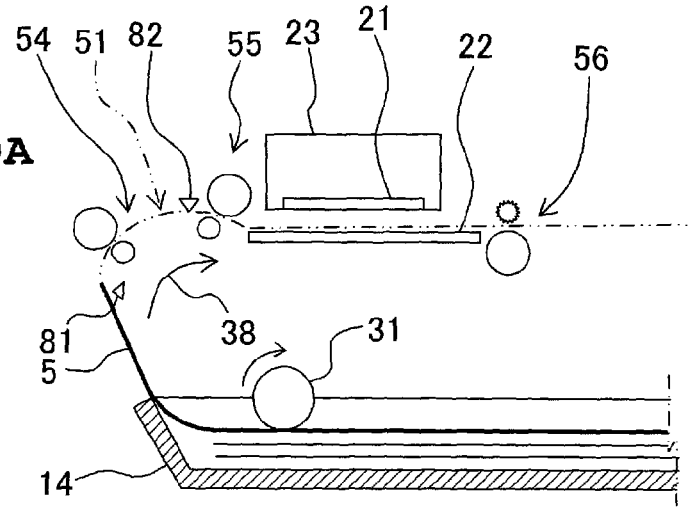
FIGS. 10A, 10B and 10C illustrate the operation of the multifunction machine in the first recording mode.
Figure 10B:
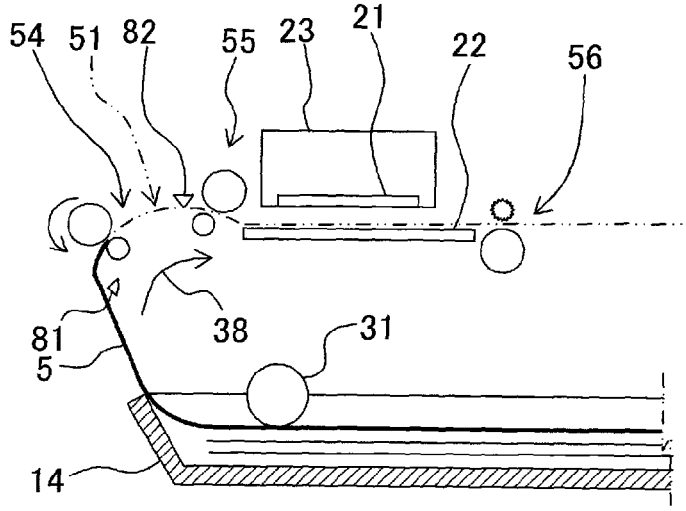
Figure 10C:
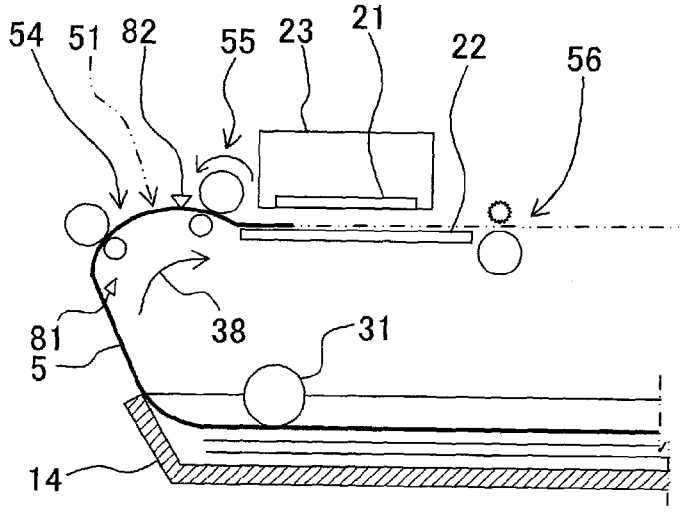
Figure 11A:
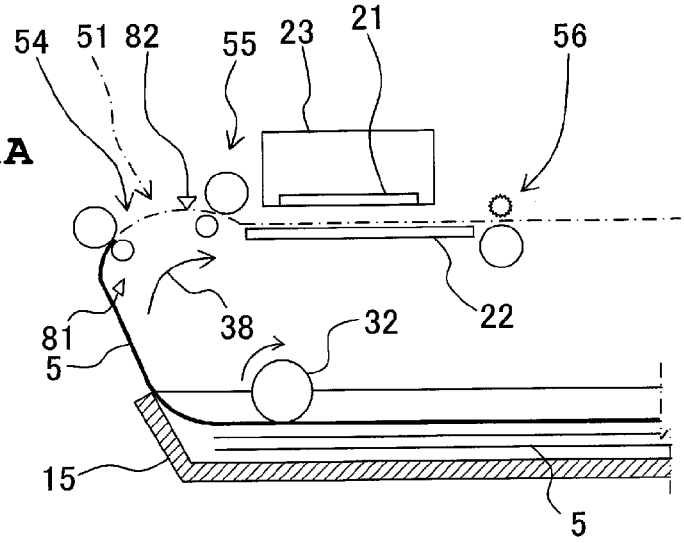
FIGS. 11A, 11B and 11C illustrate the operation of the multifunction machine in the second recording mode.
Figure 11B:
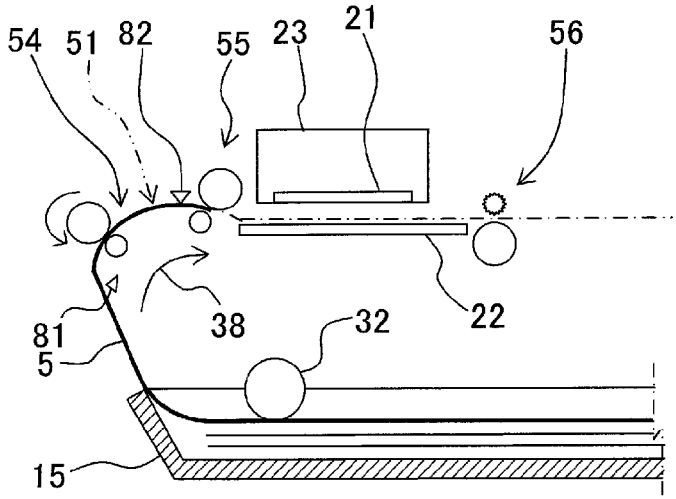
Figure 11C:
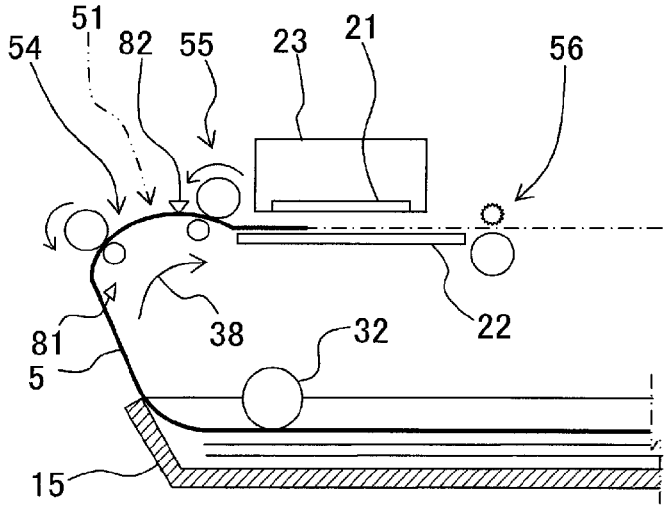

An explanation will be made below about a multifunction machine 10 shown in FIG. 10 having, for example, the printing, scanning, copying, and facsimile functions as an image recording apparatus according to an embodiment of the present teaching. The multifunction machine 10 is formed to have an approximately rectangular parallelepiped shape. The following description will be made assuming that the height direction of the multifunction machine 10 is defined as the upward-downward direction 7, the depth direction is defined as the front-back direction 8, and the widthwise direction is defined as the left-right direction 9.

Outline of Multifunction Machine 10

The multifunction machine 10 is provided with a printer casing 11, a scanner casing 12 which is arranged on an upper portion of the printer casing 11 and which accommodates a scanner section, and a manuscript cover 13 which is arranged on an upper portion of the scanner casing 12. The printer casing 11 accommodates, in an upper portion, a printer section 17 shown in FIG. 2 for recording an image on the recording paper (recording medium) 5 which is, for example, the regular paper, the glossy paper, or the post card. The printer section 17 accommodates, in a lower portion, an upper tray 14 and a lower tray 15 on which sheets of the recording paper 5 are placed so that the upper tray 14 and the lower tray 15 are drawable frontwardly. A paper discharge tray 16 is placed on the upper tray 14.

Figure 1:
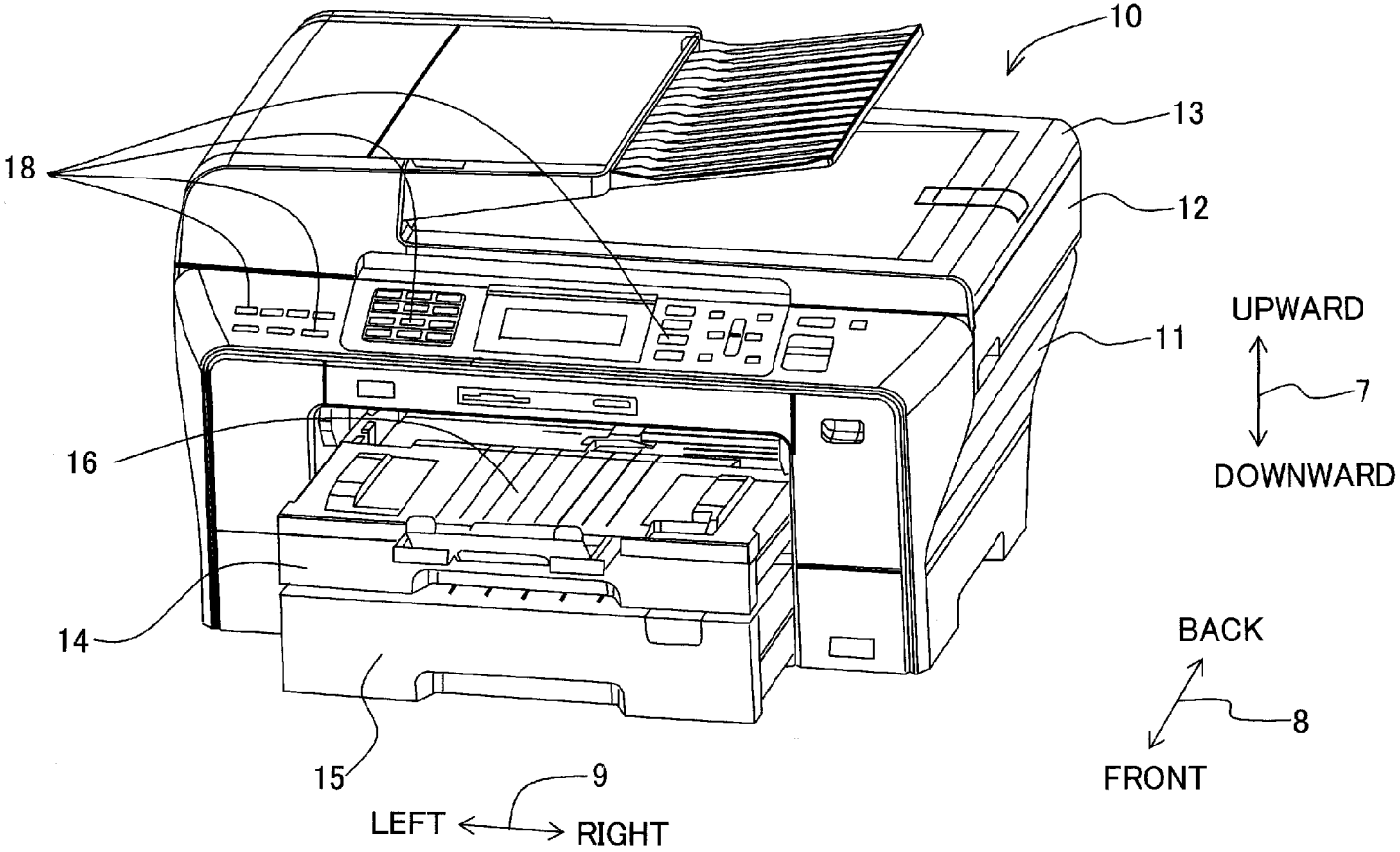
FIG. 1 shows a perspective view illustrating a multifunction machine.
Figure 9:
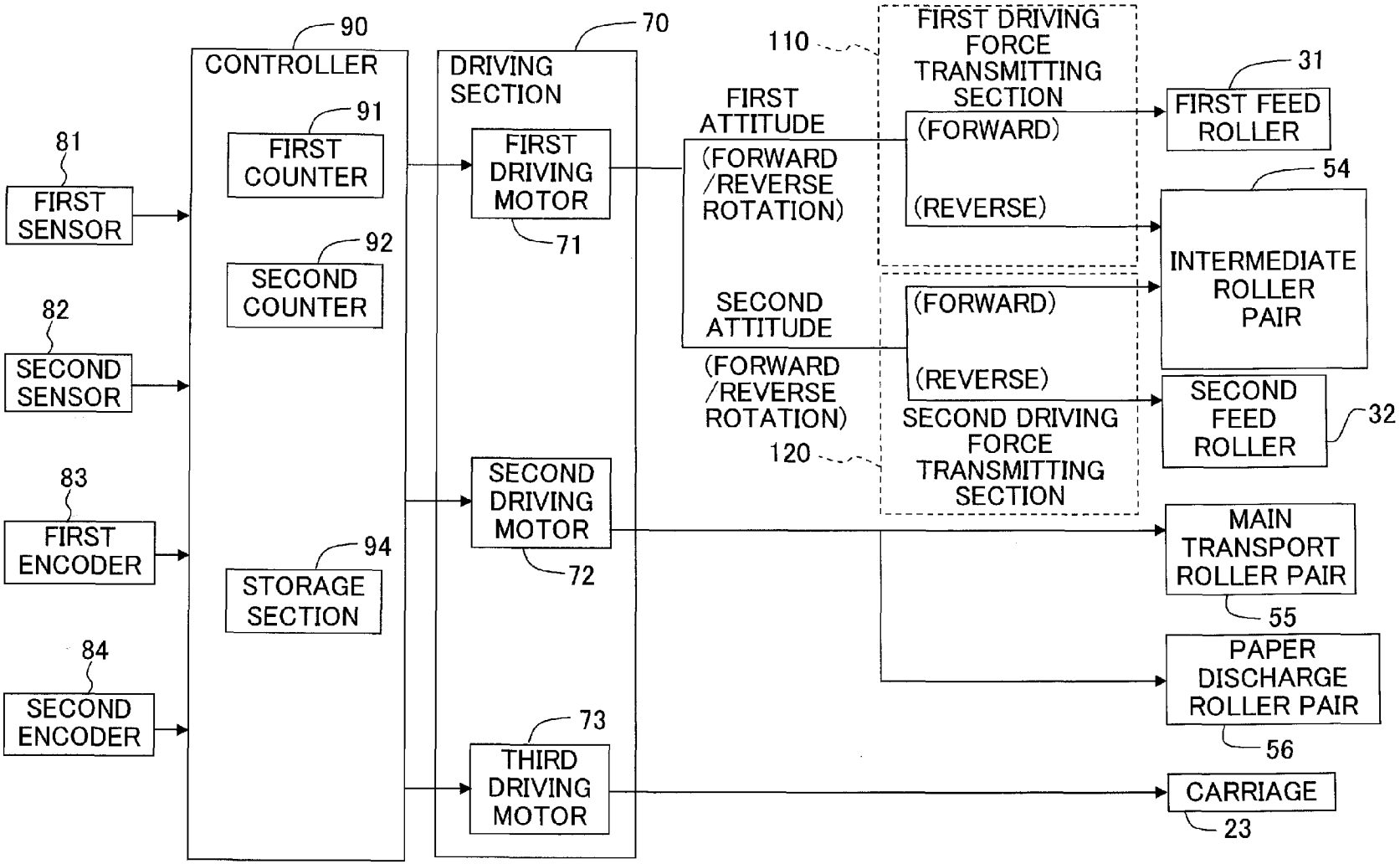
FIG. 9 shows a block diagram according to an embodiment of the present embodiment.

The scanner section and the printer section 17 are controlled by a control unit (controller) 90 shown in FIG. 9. The control unit 90 is realized, for example, by various electronic parts of a microcomputer or the like mounted on a board. The control unit 90 performs the import of the image and the recording of the image in accordance with the signal inputted from a plurality of input buttons 18 shown in FIG. 1 or from the external apparatus such as a personal computer or the like. The control unit 90 will be described in detail later on.

Printer Section 17

Figure 2:
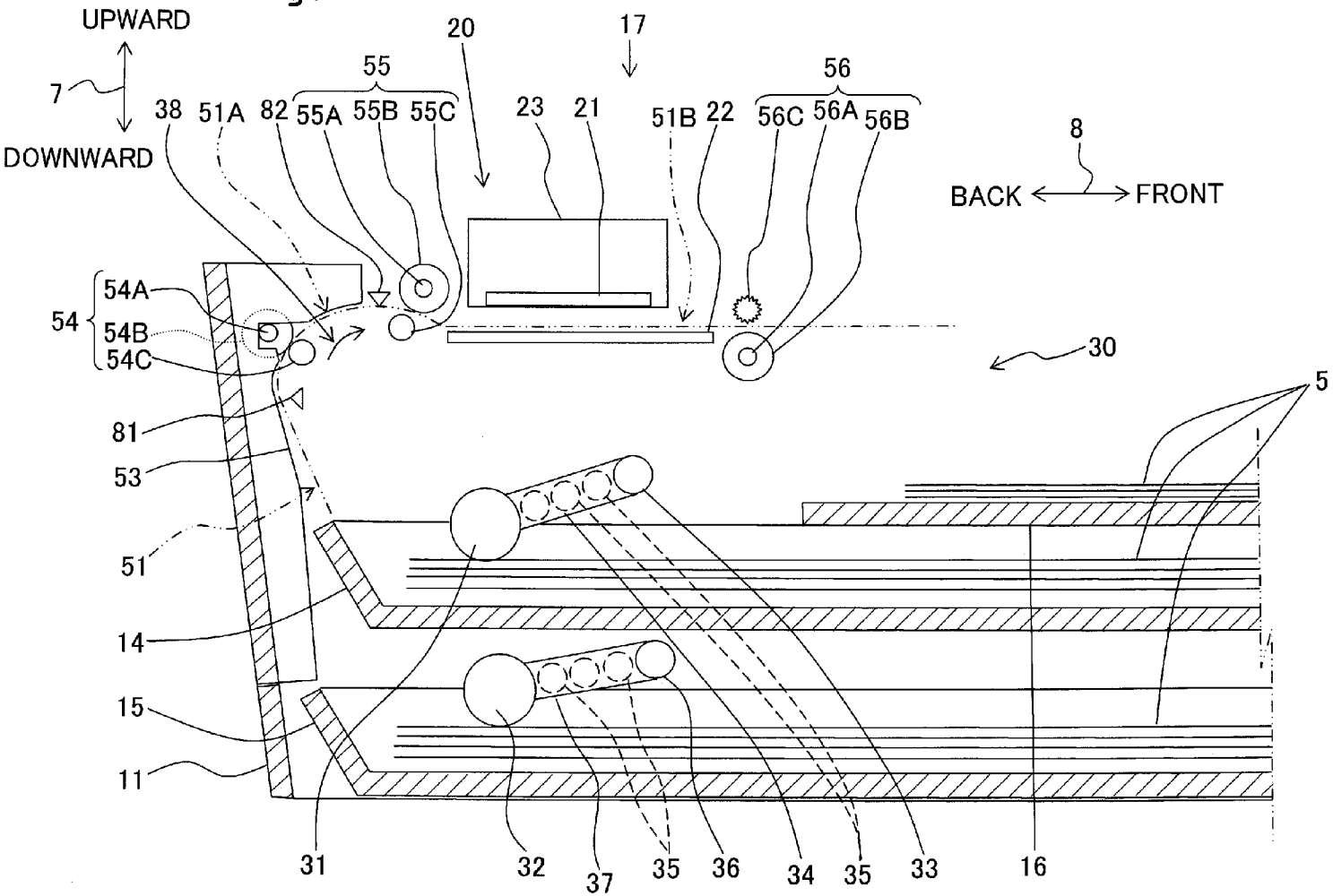
FIG. 2 shows a schematic sectional view illustrating a printer section.

As shown in FIG. 2, the printer section 17 includes a transport apparatus 30 which transports the recording paper 5 placed on the upper tray 14 and the lower tray 15, a recording section 20 which records the image on the recording paper 5 transported by the transport apparatus 30, a driving section 70 (see FIG. 9) and a driving force transmitting/switching mechanism 40 (see FIG. 3), and a detecting mechanism which is composed of, for example, a first sensor 81 as described later on.

Recording Section 20

As shown in FIG. 2, the recording section 20 includes a plate-shaped platen 22 which is arranged over or above a back portion of the upper tray 14, a recording head 21 which is arranged opposingly over or above the platen 22, and a carriage 23 which holds the recording head 21.

The recording head 21 is provided with a plurality of unillustrated nozzles. The respective nozzles include discharge ports which are open downwardly respectively. The respective nozzles are deformed, for example, by a piezoelectric element, and thus ink droplets are discharged respectively from the discharge ports toward the platen 22 disposed thereunder. The electric power is supplied to the piezoelectric element by using, for example, a flexible cable, and the control is performed by the control unit 90.

Figure 3:
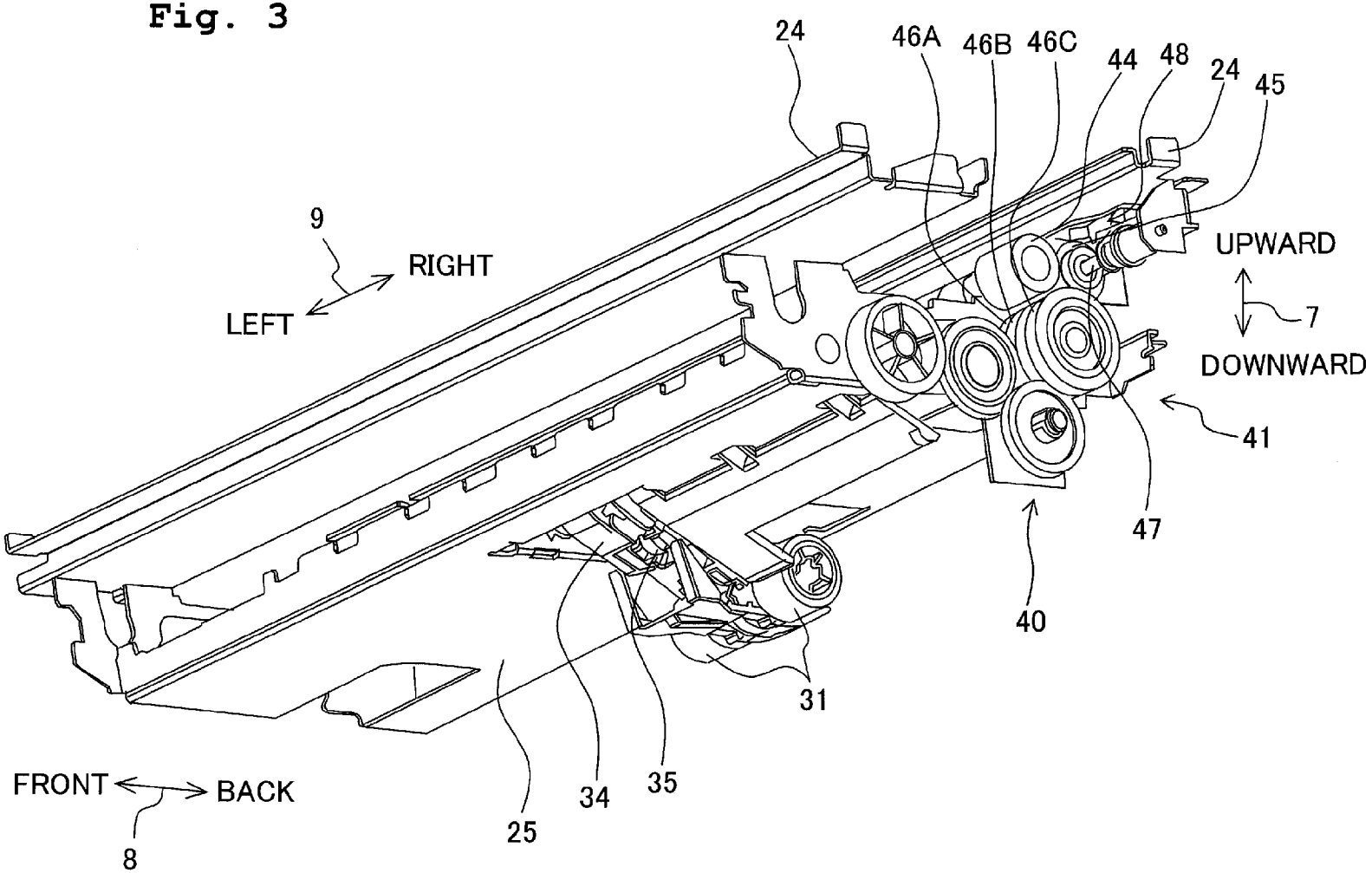
FIG. 3 shows a perspective view illustrating a driving force transmitting/switching mechanism.

The carriage 23 extends over a pair of front and back rail members 24 shown in FIG. 3 which are arranged over or above the platen 22. The carriage 23 is supported movably in the left-right direction 9 by the rail members 24. The rail members 24 are formed to have plate-shaped forms which are long in the left-right direction 9, and the rail members 24 are supported by a frame 25. An abutment tab 26 (see FIG. 4) protrudes rightwardly from the right end portion of the carriage 23 in order to switch the gear in the driving force transmitting/switching mechanism 40.

Transport Apparatus 30

The transport apparatus 30 shown in FIG. 2 includes a first feed roller 31 which feeds the recording paper 5 placed on the upper tray 14, a second feed roller 32 which feeds the recording paper 5 placed on the lower tray 15, a main transport passage 51 through which the recording paper 5 fed by the first feed roller 31 or the second feed roller 32 is transported, an intermediate roller pair 54, a main transport roller pair 55, and a paper discharge roller pair 56 which are equipped for the main transport passage 51 and which nip (interpose) and transport the recording paper 5.

First Feed Roller 31, Second Feed Roller 32

The first feed roller 31 is arranged over or above a back portion of the upper tray 14. The first feed roller 31 is supported by using an arm 34 and a rotary shaft 33 driven and rotated by the driving section 70. The arm 34 has one end to which the first feed roller 31 is rotatably attached and the other end which is rotatably supported by the rotary shaft 33. The arm 34 is provided with a plurality of transmission gears 35 for transmitting the rotation of the rotary shaft 33 to the first feed roller 31.

The first feed roller 31 is brought in contact with the recording paper 5 placed on the upper tray 14 in accordance with the rotation of the arm 34 about the rotary shaft 33. The first feed roller 31 is rotated in accordance with the rotation of the rotary shaft 33 transmitted by the transmission gears 35 so that the recording paper 5, with which the first feed roller 31 is brought in contact, is fed upwardly from the back wall of the upper tray 14. The second feed roller 32 is supported by using an arm 37 and a rotary shaft 36 in the same manner as the first feed roller 31. The recording paper 5, which is placed on the lower tray 15, is fed in accordance with the rotation of the second feed roller 32.

Main Transport Passage 51

The main transport passage 51 is formed by a guide member 53 and the platen 22. The main transport passage 51 is so-called a U-turn pass provided with a curved section 51A (curved portion 51A) which has a circular arc-shaped cross section and a straight section 51B (straight portion 51B) which has a straight line-shaped cross section and which passes through the space between the platen 22 and the recording head 21. Owing to the curved section 51A, the recording section 20 can be arranged over or above the upper tray 14, and the multifunction machine 10 is compact.

The main transport passage 51 has one end which is positioned over or above the back wall of the upper tray 14 and the other end which is positioned over or above the paper discharge tray 16. The recording paper 5, which is fed from the upper tray 14 or the lower tray 15, is transported frontwardly on the platen 22, and the recording paper 5 is discharged to the paper discharge tray 16.

Intermediate Roller Pair 54

The intermediate roller pair 54 is provided with a plurality of driving rollers 54B which are secured to a rotary shaft 54A rotated by the driving section 70, and driven rollers 54C which are driven while following the driving rollers 54B. The intermediate roller pair 54 is arranged at a position at which the axial direction or shaft direction of the rotary shaft 54A is in the left-right direction 9 and the curved section 51A passes through the nip position. The intermediate roller pair 54 interposes and transports the recording paper 5 fed from the upper tray 14 or the lower tray 15.

The multifunction machine (image recording apparatus) can be made compact by providing the curved section at the transport passage as described above. However, it is feared that the recording paper (recording medium) to be transported may receive the frictional force at the curved section, and the position accuracy of the image recording may be lowered. In this embodiment, the intermediate roller pair 54 is provided at the curved section 51A to thereby assist the transport of the recording paper 5 performed by the main transport roller pair 55 as described later on. It is possible to reduce the friction of the recording paper 5 received at the curved section 51A.

On the other hand, it is feared that the electric power consumption amount, which is required for the multifunction machine 10 to transport one sheet of the recording medium, may be increased due to the intermediate roller pair 54 which is newly provided. However, in the case of the multifunction machine 10 according to this embodiment, it is possible to perform the high speed image recording and the highly accurate image recording while suppressing the increase in the cost by the recording operation as described later on.

Main Transport Roller Pair 55

The main transport roller pair 55 is provided with a plurality of driving rollers 55B which are secured to a rotary shaft 55A rotated by the driving section 70, and driven rollers 55C which are driven while following the driving rollers 55B. The main transport roller pair 55 is arranged such that the axial direction or shaft direction of the rotary shaft 55A is in the left-right direction 9 at the back of the platen 22. The recording paper 5, which is transported by the intermediate roller pair 54, is transported frontwardly by the main transport roller pair 55.

Paper Discharge Roller Pair 56

The paper discharge roller pair 56 is provided with a plurality of driving rollers 56B which are secured to a rotary shaft 56A rotated by the driving section 70, and driven rollers 56C which are driven while following the driving rollers 56B. The paper discharge roller pair 56 is arranged such that the axial direction or shaft direction of the rotary shaft 56A is in the left-right direction 9 in front of the platen 22. The recording paper 5, which is transported by the main transport roller pair 55, is discharged to the paper discharge tray 16 by the paper discharge roller pair 56.

Driving Section 70

As shown in FIG. 9, the driving section 70 is provided with a first driving motor 71, a second driving motor 72, and a third driving motor 73 which are rotatable in any one of the forward and reverse directions. For example, DC motors are used for the respective driving motors 71, 72, 73. The electric power is supplied from an unillustrated power source unit to the respective driving motors 71, 72, 73. The control unit 90 controls the electric power supply from the power source unit to the respective driving motors 71, 72, 73 to drive and control the respective driving motors 71, 72, 73.

First Driving Motor 71

The driving force of the first driving motor 71 is transmitted to the first feed roller 31, the second feed roller 32, the intermediate roller pair 54, and an unillustrated preserving mechanism by the driving force transmitting/switching mechanism 40 as described later on.

Second Driving Motor 42

The second driving motor 72 has a shaft which is connected to the rotary shaft 55A of the main transport roller pair 55 directly or via gears so that the rotary shaft 55A is driven and rotated. The driving force of the second driving motor 72 is transmitted to the rotary shaft 56A by an unillustrated first belt transmission mechanism. The first belt transmission mechanism is provided with an annular endless belt. When the rotary shaft 55A is rotated by the second driving motor 72, the rotary shaft 56A is rotated together with the rotary shaft 55A. The main transport roller pair 55 and the paper discharge roller pair 56 are simultaneously rotated in the direction in which the recording paper 5 is transported in the same transport direction 38 by the second driving motor 72 and the first belt transmission mechanism. The direction of rotation of the second driving motor 72 is defined assuming that the recording paper 5 is transported in the transport direction 38 in accordance with the forward rotation of the second driving motor 72, and the following description will be made under this definition.

Third Driving Motor 73

The driving force of the third driving motor 73 is transmitted to the carriage 23 by an unillustrated second belt transmission mechanism so that the carriage 23 is moved in the left-right direction 9. The second belt transmission mechanism is provided with, for example, an annular endless belt to which the carriage 23 is secured. The belt is rotated by the third driving motor 73, and thus the carriage 23 is moved in the leftward direction or the rightward direction.

Driving Force Transmitting/Switching Mechanism 40

The driving force transmitting/switching mechanism 40 shown in FIG. 3 is provided with a gear change mechanism (gear switching mechanism) 41, a first driving force transmitting section 110 (see FIG. 13A) which transmits the driving force subjected to the switching by the gear change mechanism 41 to the first feed roller 31 or the intermediate roller pair 54, and a second driving force transmitting section 120 (see FIG. 13B) which transmits the driving force subjected to the switching by the gear change mechanism 41 to the second feed roller 32 or the intermediate roller pair 54. The driving force transmitting/switching mechanism 40 is arranged on the right side of the platen 22.

Gear Change Mechanism 41

Figure 4:
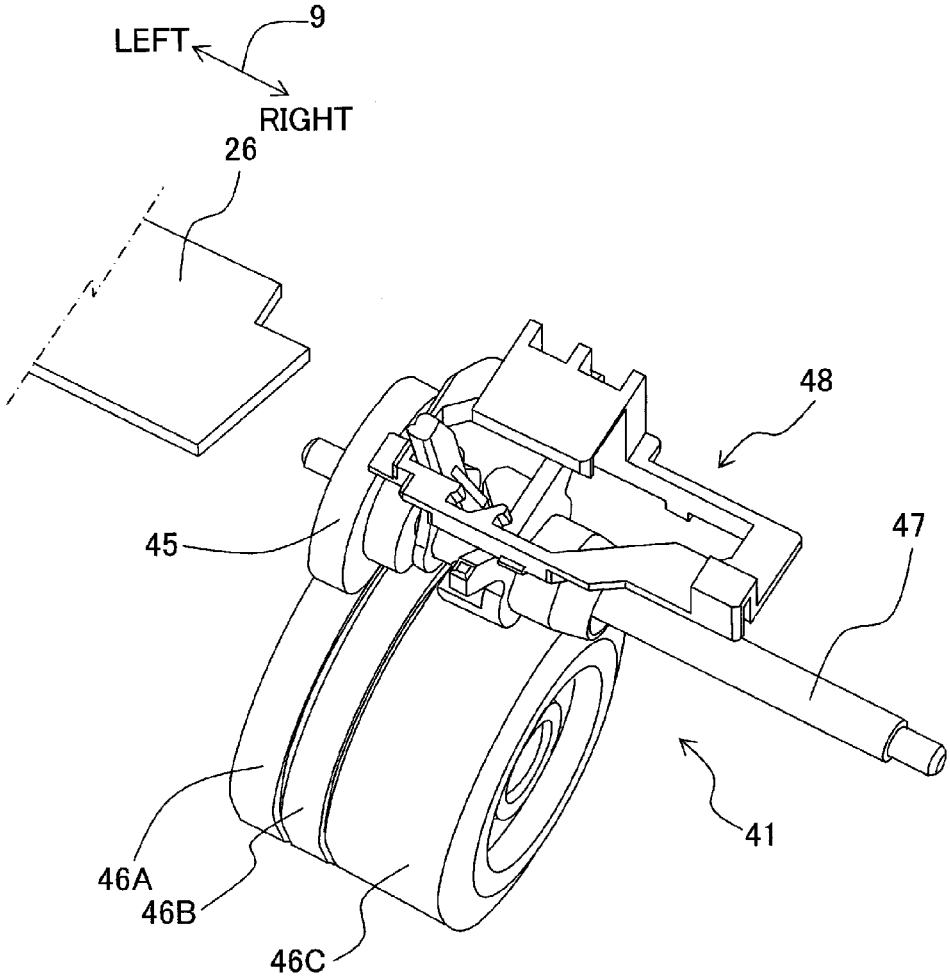
FIG. 4 shows a perspective view illustrating a gear change mechanism (gear switching mechanism) in a first attitude.
Figure 5A:
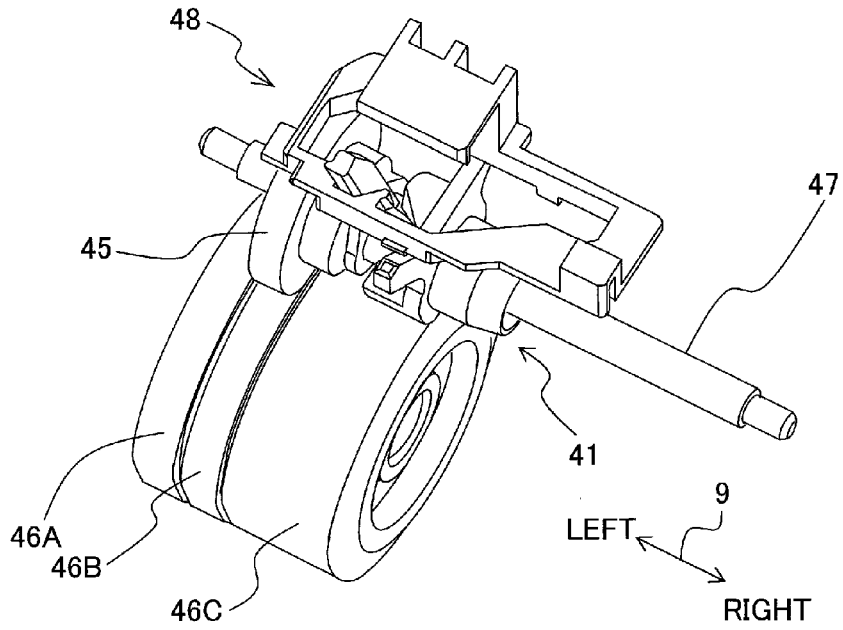
FIG. 5A shows a perspective view illustrating the gear change mechanism in a second attitude.
Figure 5B:
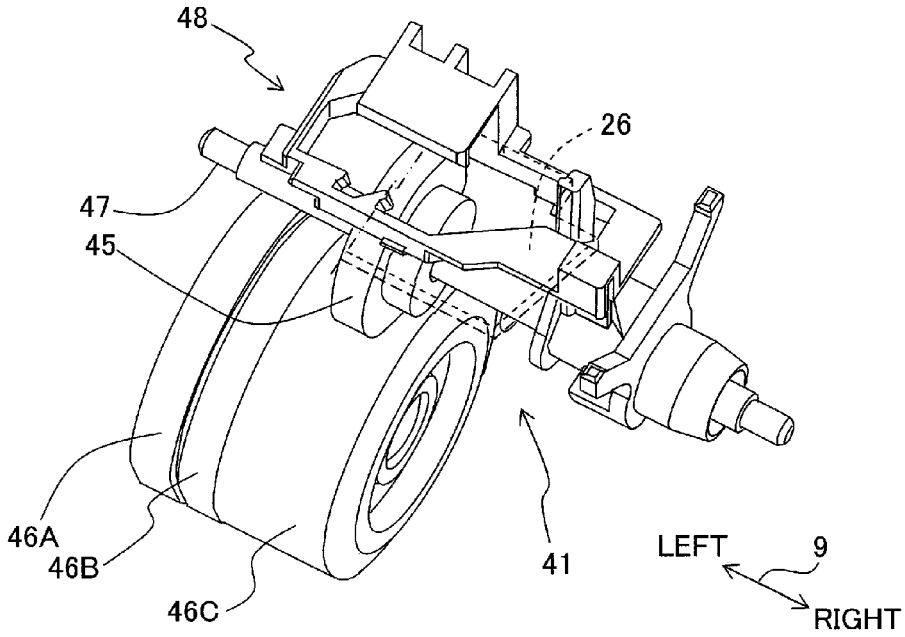
FIG. 5B shows a perspective view illustrating the gear change mechanism in a third attitude.

As shown in FIGS. 3 to 5, the gear change mechanism 41 is provided with a driving gear 44 which is driven and rotated by the first driving motor 71, a switching gear (changeover gear) 45, a first receiving gear 46A, a second receiving gear 46B, and a third receiving gear 46C which have teeth capable of being meshed with the switching gear 45 respectively, and a holding mechanism 48 (see FIG. 5) which holds the switching gear 45.

Driving Gear 44, Switching Gear 45

A support shaft 47 is arranged substantially in parallel to the rotary shaft of the driving gear 44. The switching gear 45 is allowed to pass through the support shaft 47. The switching gear 45 is rotatable about the axis of the support shaft 47, and the switching gear 45 is movable in the axial direction or shaft direction (left-right direction 9) of the support shaft 47. The switching gear 45 is formed to have a widthwise dimension which is smaller than a widthwise dimension of the driving gear 44 in the left-right direction 9. The switching gear 45 undergoes the attitude change to the first attitude, the second attitude, and the third attitude by being moved in the left-right direction 9 within the range of the widthwise dimension of the driving gear 44 described above. The switching gear 45 is meshed with the driving gear 44 in any one of the attitudes. The attitude, in which the switching gear 45 is meshed with the left end portion of the driving gear 44, is designated as the first attitude. The attitude, in which the switching gear 45 is meshed with the right end portion of the driving gear 44, is designated as the third attitude. As the switching gear 45 is moved in the rightward direction, the attitude is changed in an order of the first attitude shown in FIG. 4, the second attitude shown in FIG. 5A, and the third attitude shown in FIG. 5B.

Holding Mechanism 48

The holding mechanism 48 is not described in detail. However, the holding mechanism 48 has the following function. That is, the holding mechanism 48 holds the switching gear 45 in the first attitude shown in FIG. 4 and the second attitude shown in FIG. 5A subjected to the attitude change from the first attitude, and the holding mechanism 48 does not hold the switching gear 45 in the third attitude shown in FIG. 5B and the second attitude subjected to the attitude change from the third attitude. Further, the holding mechanism 48 has the following function. That is, the holding mechanism 48 allows the switching gear 45 to undergo the attitude change to the first attitude, the second attitude, and the third attitude by being pushed from the left side by the abutment tab 26 provided for the carriage 23 as described above.

First Receiving Gear 46A. Second Receiving Gear 46B, Third Receiving Gear 46C As shown in FIGS. 4 and 5, the first receiving gear 46A, the second receiving gear 46B, and the third receiving gear 46C are formed to have mutually identical diameters respectively. The first receiving gear 46A, the second receiving gear 46B, and the third receiving gear 46C are arranged so that the rotary shafts are aligned on a straight line and the rotary shafts are disposed in the axial direction or shaft direction of the support shaft 47. The first receiving gear 46A is arranged at the position at which the first receiving gear 46A is meshed with the switching gear 45 in the first attitude. The second receiving gear 46B is arranged at the position at which the second receiving gear 46B is meshed with the switching gear 45 in the second attitude. The third receiving gear 46C is arranged at the position at which the third receiving gear 46C is meshed with the switching gear 45 in the third attitude. The switching gear 45 is meshed with any one of the first receiving gear 46A, the second receiving gear 46B, and the third receiving gear 46C, and any one of the first receiving gear 46A, the second receiving gear 46B, and the third receiving gear 46C is selected and rotated. The third receiving gear 46C is provided to drive the unillustrated preserving mechanism. The preserving mechanism is, for example, the maintenance mechanism for executing the maintenance for the recording head 21, for which any detailed explanation is omitted.

First Driving Force Transmitting Section 110

Figure 13A:
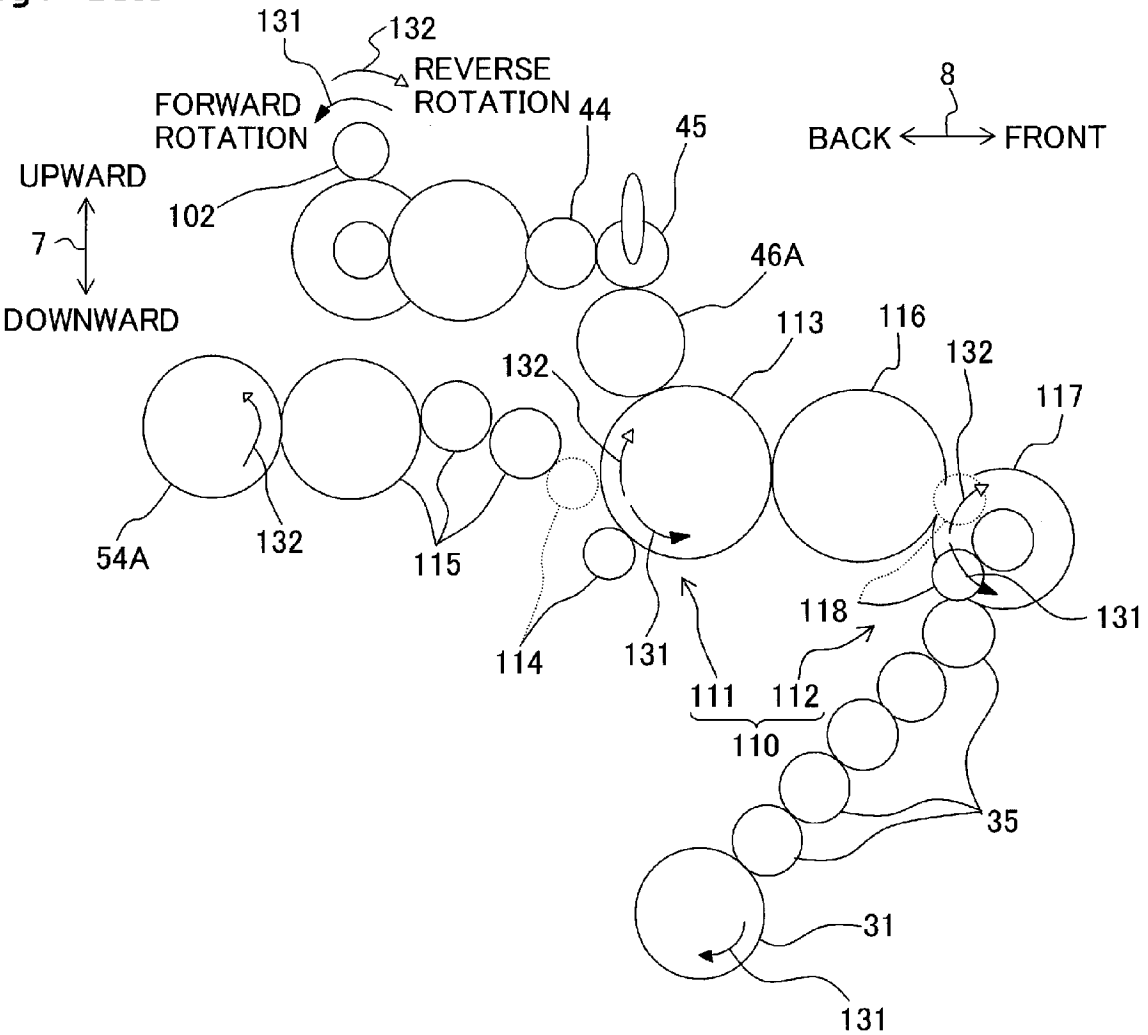
FIG. 13A shows a schematic plan view illustrating a first driving force transmitting section.

As shown in FIG. 13A, the first driving force transmitting section 110 is provided with a first planetary gear mechanism 111 and a second planetary gear mechanism 112. The first planetary gear mechanism 111 includes a sun gear 113 which is meshed with the first receiving gear 46A, and a planet gear 114 which revolves or turns on its axis while revolving or moving around the sun gear 113. When the first driving motor 71 is rotated reversely (see the arrow 132), the planet gear 114 is meshed with one of the plurality of transmission gears 115 to transmit the rotation to the rotary shaft 54A of the intermediate roller pair 54 (see the dotted lines for 114). The second planetary gear mechanism 112 includes a sun gear 117 to which the rotation of the sun gear 113 is transmitted by the transmission gear 116, and a planet gear 118 which revolves or turns on its axis while revolving or moving around the sun gear 117. When the first driving motor 71 is rotated forwardly (see the arrow 131), the planet gear 118 is meshed with one of the plurality of transmission gears 35 to transmit the rotation to the first feed roller 31 (see the solid lines for 118). According to the arrangement as described above, the first driving force transmitting section 110 is operated such that the driving force of the first driving motor 71 rotated forwardly (rotated in forward direction) is transmitted to the first feed roller 31, the driving force of the first driving motor 71 rotated reversely (rotated in reverse direction) is transmitted to the intermediate roller pair 54, and the driving force is not transmitted to the first feed roller 31.

Second Driving Force Transmitting Section 120

Figure 13B:
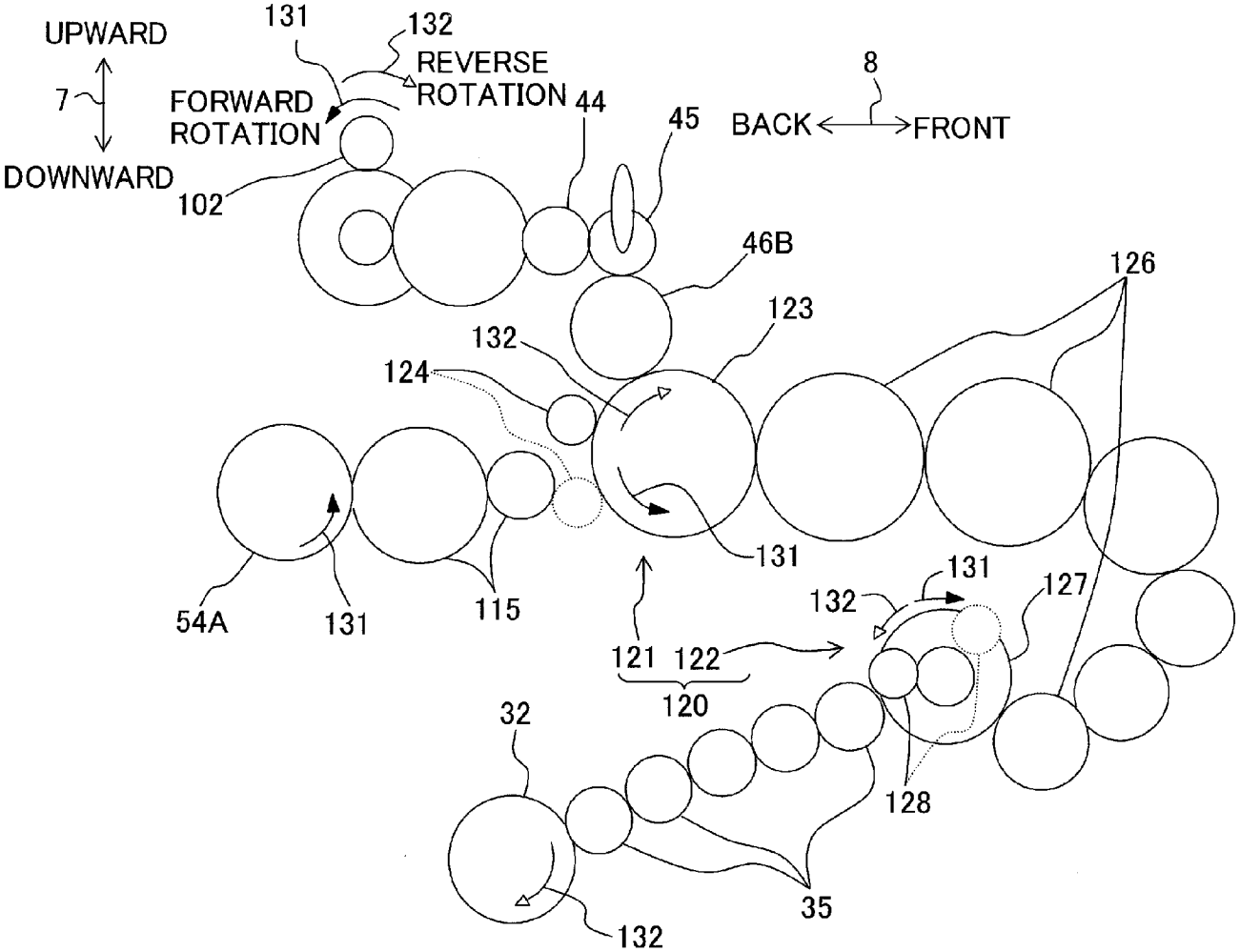
FIG. 13B shows a schematic plan view illustrating a second driving force transmitting section.

As shown in FIG. 13B, the second driving force transmitting section 120 is constructed in the same manner as the first driving force transmitting section 110. The second driving force transmitting section 120 includes two planetary gear mechanisms, i.e., a third planetary gear mechanism 121 and a fourth planetary gear mechanism 122. The second driving force transmitting section 120 is operated such that the driving force of first driving motor 71 rotated reversely (see the arrow 132) is transmitted to the second feed roller 32, the driving force of the first driving motor 71 rotated forwardly (see the arrow 131) is transmitted to the intermediate roller pair 54, and the driving force is not transmitted to the second feed roller 32.

Detecting Mechanism

The detecting mechanism is provided with the first sensor 81 and a second sensor 82 shown in FIG. 2 and a first encoder 83 and a second encoder 84 shown in FIG. 9. The first sensor 81 is arranged on the upstream side of the intermediate roller pair 54 in the transport direction 38. The second sensor 82 is arranged on the upstream side of the main transport roller pair 55 in the transport direction 38.

The first sensor 81 and the second sensor 82 are so-called registration sensors, and their structures are well-known, for which any detailed explanation is not made. Each of the first sensor 81 and the second sensor 82 is composed of, for example, a light emitting diode, a photodiode, a detecting element which is provided so that the detecting element can appear and disappear in the main transport passage 51. The first sensor 81 and the second sensor 82 detect the recording paper 5 and the output is changed between the situation in which the recording paper 5 is allowed to pass and the situation in which the recording paper 5 is not allowed to pass. The following explanation is made assuming that the outputs of the first sensor 81 and the second sensor 82, which are provided when the recording paper 5 is allowed to pass, are designated as the first outputs, and the outputs, which are provided when the recording paper 5 is not allowed to pass, are designated as the second outputs.

The structure of the encoder is well-known, for which any detailed explanation is not made. The encoder includes, for example, a light emitting diode, a photodiode, and a disk. The encoder is constructed such that the disk is provided with a light transmitting portion through which the light is transmitted and a light shielding portion which blocks or shuts off the light. When the disk is rotated, then the light transmitting portion and the light shielding portion alternately pass through the optical path for the light emitting diode, and the output of the photodiode is changed. The disk is attached, for example, to the shaft of each of the driving motors 71, 72 or the rotary shaft rotated by each of the driving motors 71, 72. The first encoder 82 is equipped for the first driving motor 71. The second encoder 84 is equipped for the second driving motor 72.

The control unit 90 is provided with a first counter 91 which counts the output change of the first encoder 83, a second counter 92 which counts the output change of the second encoder 84, and a storage section 94.

The storage section 94 stores first to fourth predetermined values. The first predetermined value is the threshold value for the count value of the first counter 91. The first predetermined value is set as such a value that at least a predetermined rotation amount is provided after the forward end of the recording paper 5 allowed to pass along the first sensor 81 arrives at the intermediate roller pair 54. The second predetermined value is the threshold value for the count value of the first counter 91. The second predetermined value is set as such a value that at least a predetermined rotation amount is provided after the forward end of the recording paper 5 arrives at the main transport roller pair 55. The forward end of the recording paper 5 means the forward end (front end) of the recording paper 5 in the transport direction 38. The third predetermined value is the threshold value for the count value of the first counter 91. The third predetermined value is a value provided to judge that the forward end of the recording paper 5 arrives at the main transport roller pair 55. The fourth predetermined value is the threshold value for the count value of the second counter 92. The fourth predetermined value is a value to determine the cueing of the recording paper 5, i.e., the position at which the image recording on the recording paper 5 is started. The fourth predetermined value is inputted from the outside, for example, as the image data, which is stored in the storage section 94.

Operation of Control Unit (Controller) 90

The operation of the control unit will be explained with reference to FIGS. 6 to 11. The control unit 90 controls the printer section 17 to execute the first recording mode shown in FIGS. 6 and 7 and the second recording mode shown in FIG. 8. In the first recording mode, the control unit 90 performs the printing process shown in FIG. 6 and the pre-paper feed process shown in FIG. 7.

Printing Process in First Recording Mode

When the printing instruction is received in accordance with the first recording mode, then the control unit 90 moves the carriage 23 by driving the third driving motor 73, and the switching gear 45 is subjected to the attitude change to the first attitude as described above so that the first receiving gear 46A can be driven. After that, the printing process shown in FIG. 6 is performed.

Figure 6A:
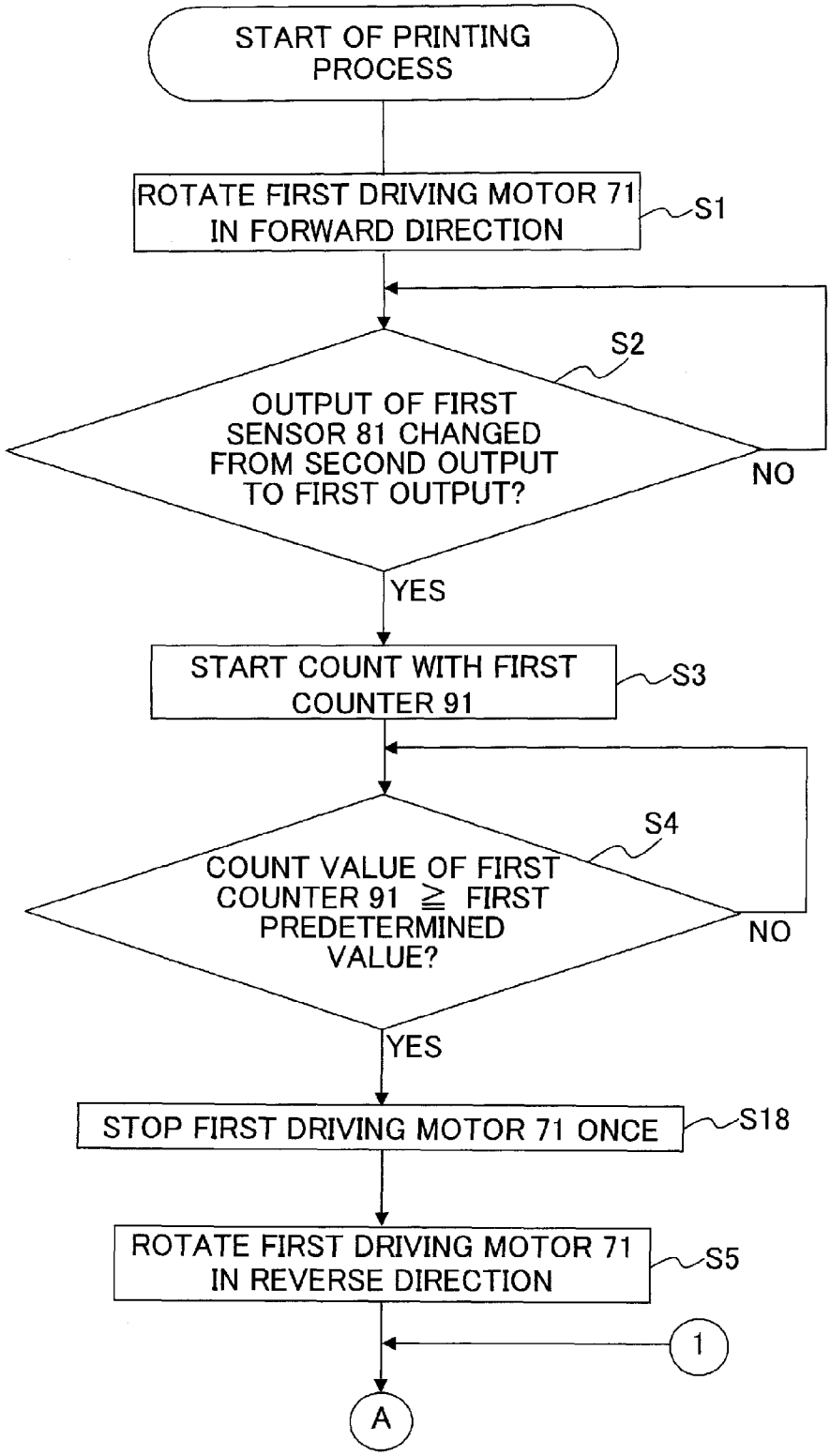
FIGS. 6A, 6B and 6C show a flow chart illustrating the printing process in a first recording mode.
Figure 6B:
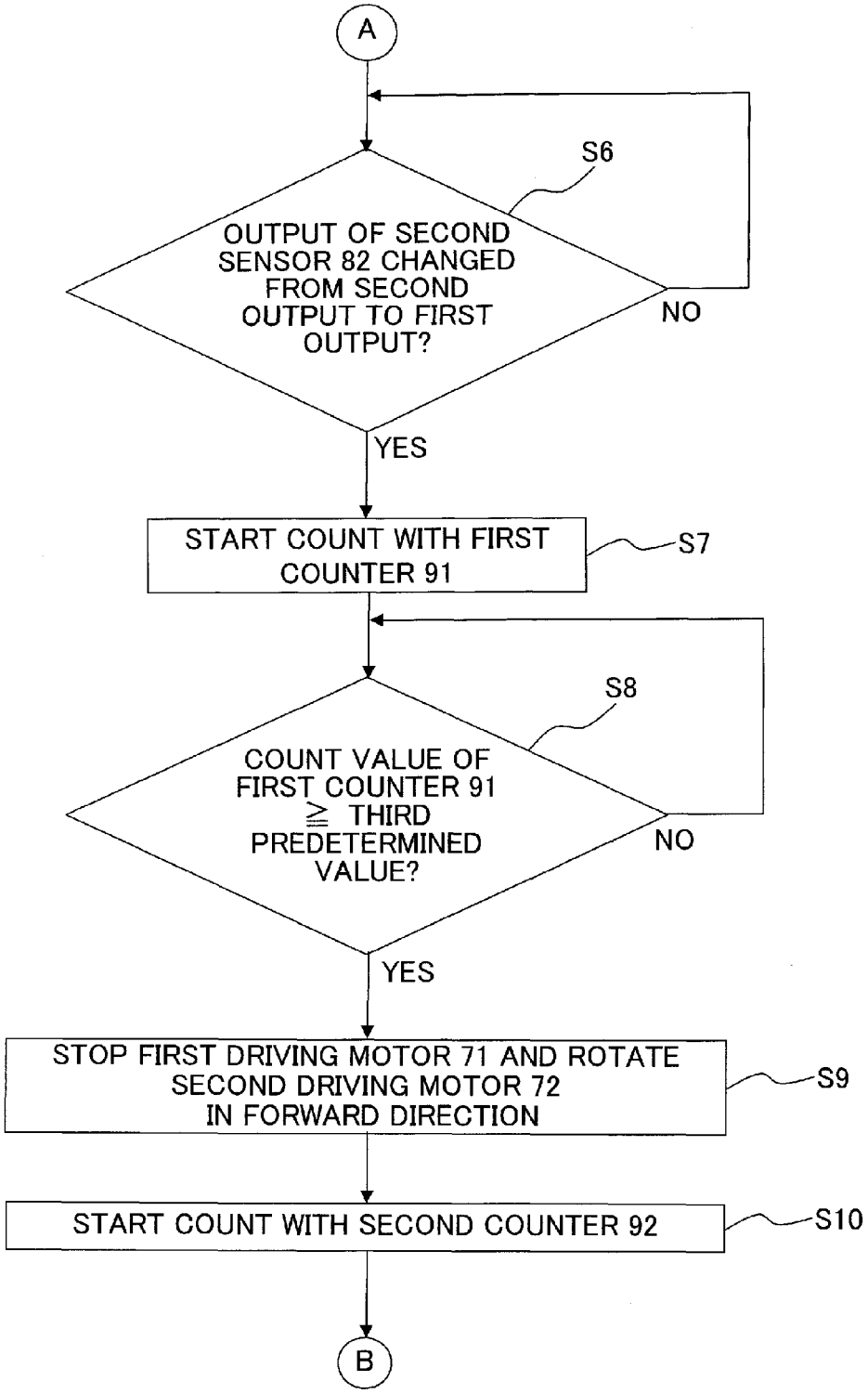
Figure 6C:
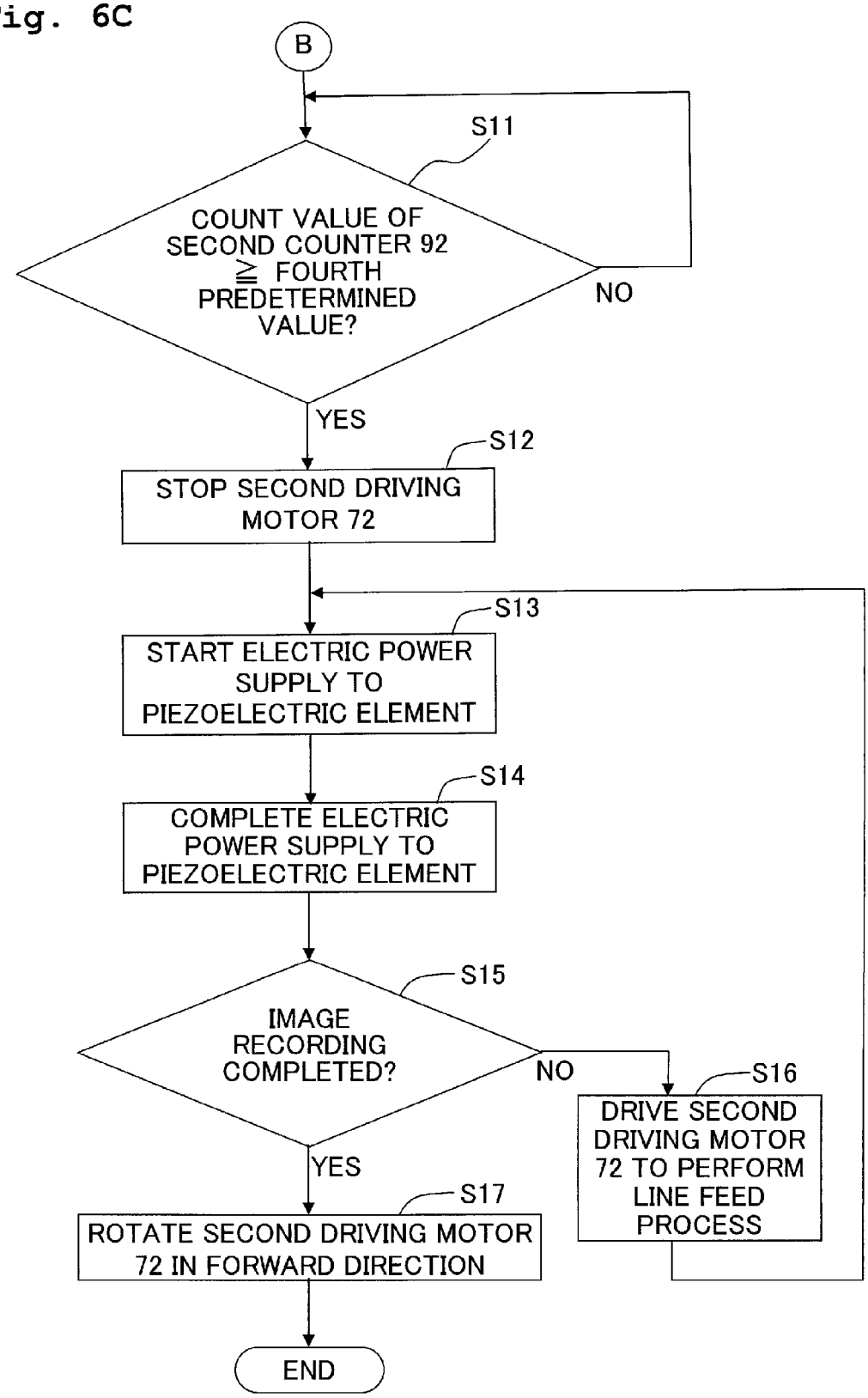

In the printing process shown in FIG. 6, the control unit 90 rotates the first driving motor 71 forwardly to rotate the first feed roller 31 (S1). The recording paper 5 is fed from the upper tray 14 to the main transport passage 51. Subsequently, if the control unit 90 detects that the output of the first sensor 81 is changed from the second output to the first output by the fed recording paper 5 (S2, Y), the control unit 90 starts the count by the first counter 91 (S3). If the count value obtained by the first counter 91 arrives at the first predetermined value (S4, Y), and the recording paper 5 abuts against the intermediate roller pair 54 (see FIG. 10A), then the driving of the first driving motor 71 is once stopped, and the rotation of the first feed roller 31 is stopped (S18). Subsequently, the control unit 90 rotates the first driving motor 71 reversely to rotate the intermediate roller pair 54 (S5), and the recording paper 5 is transported toward the main transport roller pair 55. That is, the recording paper 5 is allowed to abut against the intermediate roller pair 54, and the oblique travel is corrected. After that, the recording paper 5 is transported toward the main transport roller pair 55.

If the control unit 90 judges that the output of the second sensor 82 is changed from the second output to the first output by the recording paper 5 transported by the intermediate roller pair 54 (S6, Y), the control unit 90 starts the count by the first counter 91 (S7). If the count value of the first counter 91 arrives at the third predetermined value (S8, Y), and the forward end of the recording paper 5 arrives at the main transport roller pair 55 (see FIG. 10B), then the first driving motor 71 is stopped, the second driving motor 72 is rotated forwardly (S9), and the count is started by the second counter 92 (S10). That is, if the recording paper 5 is in the interposed state in which the recording paper 5 is interposed by the intermediate roller pair 54 and the main transport roller pair 55, then the driving of the intermediate roller pair 54 is stopped, and the recording paper 5 is transported by the main transport roller pair 55 toward the paper discharge roller pair 56 (see FIG. 10C).

If the control unit 90 judges that the count value of the second counter 92 arrives at the fourth predetermined value (S11, Y), and the cueing is completed, then the control unit 90 stops the second driving motor 72 (S12), and the supply of the electric power to the piezoelectric element is started (S13) to allow the recording head 21 to discharge the inks. The control unit 90 judges whether or not the image recording is completed (S15) after the ink discharge is completed (S14). If it is judged that the image recording is not completed (S15, N), the line feed process, in which the second driving motor 72 is rotated by a predetermined amount, is performed (S16). In the line feed process in Step S16, the control unit 90 rotates only the second driving motor 72 forwardly to transport the recording paper 5, and the first driving motor 71 is not driven. The control unit 90 alternately performs the line feed process (S16) and the ink discharge (S13, S14) to record the image on the surface of the recording paper 5. That is, the control unit 90 forwardly rotates the second driving motor 72 intermittently, and the control unit 90 allows the recording head 21 to discharge the inks during the period in which the second driving motor 72 is stopped. If the control unit 90 judges that the image recording is completed (S15, Y), then the second driving motor 72 is rotated forwardly, and the recording paper 5 is discharged to the paper discharge tray 16 (S17).

Pre-Paper Feed Process

Figure 7A:
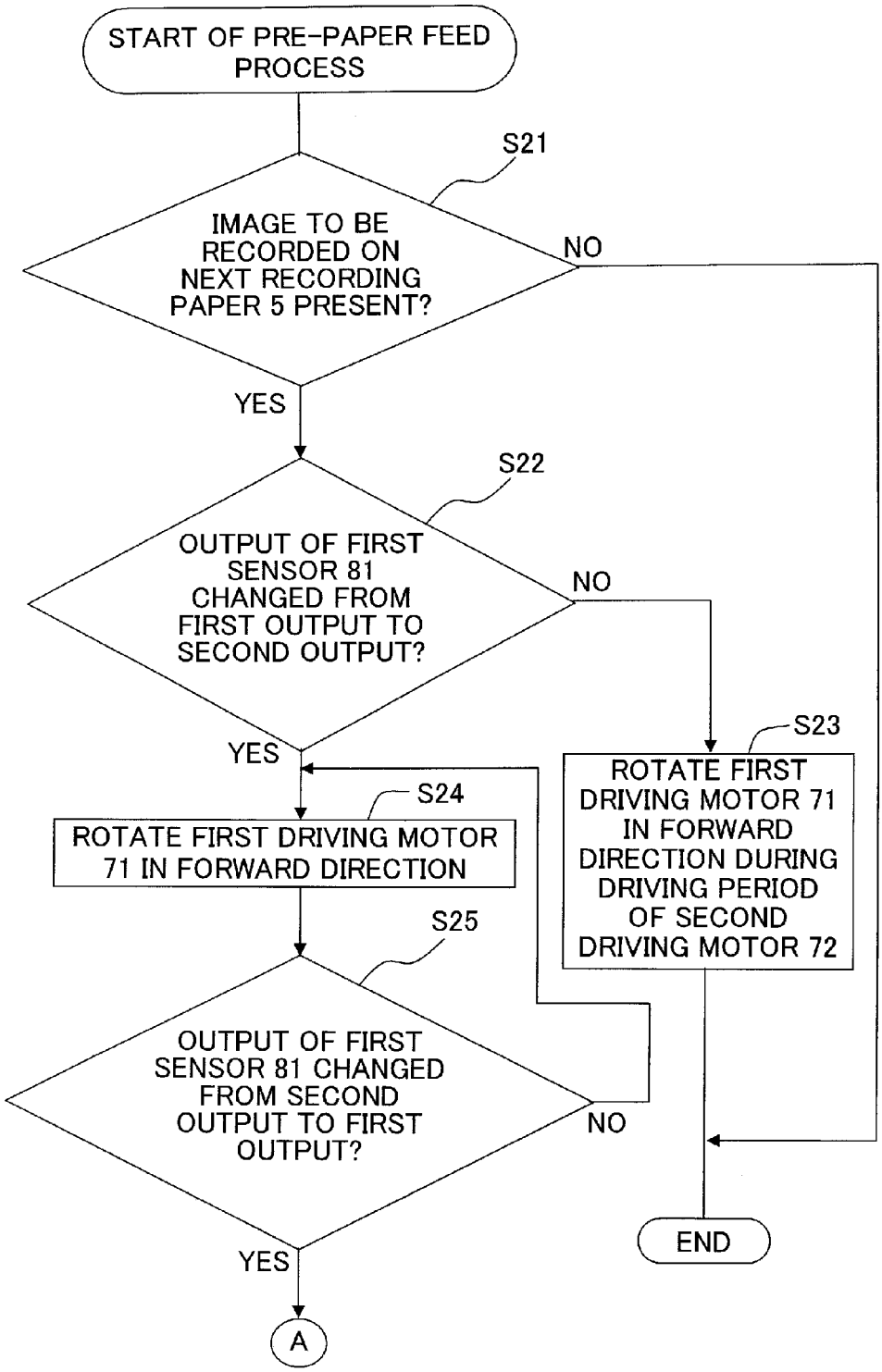
FIGS. 7A and 7B show a flow chart illustrating the pre-paper feed process in the first recording mode.
Figure 7B:
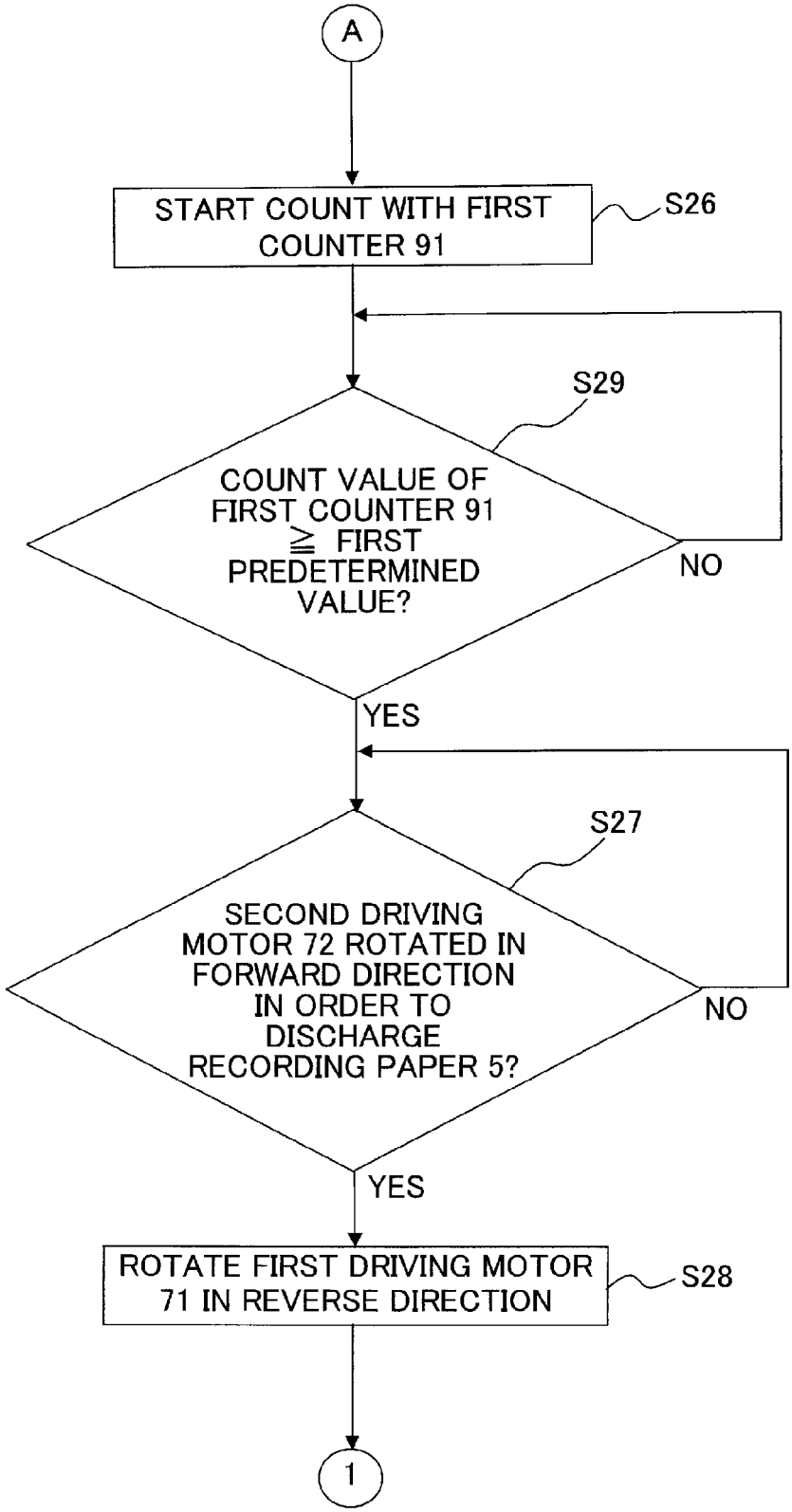

The pre-paper feed process is the process in which the next recording paper 5 is fed during the image recording on the previously fed recording paper 5 when the image recording is performed on a plurality of sheets of the recording paper 5. In this case, an explanation will be made assuming that the previously fed recording paper 5 is designated as "first recording paper 5", and the next recording paper 5 to be fed afterward is designated as "second recording paper 5". The pre-paper feed process shown in FIG. 7 is executed concurrently with the line feed process in Step S16 shown in FIG. 6. The control unit 90 judges whether or not any image to be recorded on the next recording paper 5 (second recording paper 5) is present (S21). If any image to be recorded on the second recording paper 5 is not present (S21, N), the pre-paper feed process is completed. If any image to be recorded on the second recording paper 5 is present (S21, Y), it is judged whether or not the output of the first sensor 81 is changed from the first output to the second output and the backward end of the previously fed recording paper 5 (first recording paper 5) arrives at the first sensor 81 (S22). If the backward end of the first recording paper 5 does not arrive at the first sensor 81 (S22, N), then the first driving motor 71 is rotated forwardly during the driving period of the second driving motor 72 (S23), and the pre-paper feed process is completed. In this situation, if the backward end of the first recording paper 5 has passed through the first paper feed roller 31, the second recording paper 5 is fed. The transport force of the first paper feed roller 31 is smaller than the transport force of the main transport roller pair 55. Therefore, even if the backward end of the first recording paper 5 does not pass through the first paper feed roller 31, the first recording paper 5 can be transported by the main transport roller pair 55. The transport force is herein determined by the frictional force and the nip force of each of the rollers with respect to the recording paper 5. Further, the number of revolutions or the time of rotation of the first driving motor 71 is set so that the feed amount of the recording paper 5 fed by the first feed roller 31 is smaller than the line feed width in the line feed process. The speed of rotation of the first driving motor 71 is set at a constant ratio so that the speed of rotation of the first driving motor 71 is smaller than the speed of rotation of the second driving motor 72 in the line feed process described above. Therefore, the forward end of the second recording paper 5 fed in the pre-paper feed process does not abut against the backward end of the previously fed first recording paper 5. The backward end of the first recording paper 5 can be detected by the first sensor 81. Further, the first feed roller 31 is rotated intermittently, and thus the overlapped sheets of the recording paper 5 are fed to the main transport passage 51 while being separated from each other. The first driving motor 71 may be driven during all of a plurality of driving periods of the second driving motor 72. Alternatively, the first driving motor 71 may be driven selectively (for example, during the third, fifth, and seventh driving periods).

Therefore, the first driving motor 71 is rotated forwardly during the driving period of the second driving motor 72 in the line feed process in Step S16 until the backward end of the first recording paper 5 passes through the first sensor 81, i.e., until the output of the first sensor 81 is changed from the first output to the second output. Accordingly, the second recording paper 5 can be fed during the recording on the first recording paper 5.

Subsequently, if the control unit 90 judges in Step S22 that the output of the first sensor 81 is changed from the first output to the second output and the backward end of the previously fed recording paper 5 arrives at the first sensor 81 (S22, Y), then the first driving motor 71 is rotated forwardly (S24). Further, the control unit 90 judges whether or not the forward end of the second recording paper 5 arrives at the first sensor 81 in accordance with the change of the output of the first sensor 81 from the second output to the first output (S25). If it is judged that the forward end of the second recording paper 5 does not arrive at the first sensor 81 (S25, N), the forward rotation of the first driving motor 71 is continued. If the control unit 90 judges that the forward end of the second recording paper 5 arrives at the first sensor 81 (S25, Y), the count is started by the first counter 91 (S26). The forward rotation of the first driving motor 71 is continued until it is judged that the count value of the first counter 91 arrives at the first predetermined value (S29, N), i.e., until the forward end of the second recording paper 5 arrives at the intermediate roller pair 54. The registration correction is performed by the intermediate roller pair 54. If it is judged in Step S29 that the count value of the first counter 91 arrives at the first predetermined value (S29, Y), and it is judged that the second driving motor 71 is rotated forwardly in order to discharge the first recording paper 5 (S27, Y), then the first driving motor 71 is rotated reversely, and the recording paper 5, which is allowed to wait at the intermediate roller pair 54, is transported toward the main transport roller pair 55 (S28). That is, the cueing is performed for the second recording paper 5 in cooperation with the discharge operation for the first recording paper 5. After Step S28, the control unit 90 performs the processes of Step S6 and the followings shown in FIG. 6.

According to the procedure as described above, the driving of the intermediate roller pair 54 is stopped during the period until arrival at Step S28 in which the second driving motor 72 is rotated forwardly in order to discharge the first recording paper 5 after Step S9 in which the first recording paper 5 arrives at the main transport roller 55 and the second driving motor 72 is rotated forwardly. In this way, the control unit 90 performs the stopping process in which the reverse rotation of the first driving motor 71 is stopped to stop the driving of the intermediate roller pair 54 during the predetermined period.

When the stopping process is performed as described above, it is possible to increase the electric power which can be supplied to the second driving motor 72. As a result, the main transport roller pair 55 can be rotated at a high speed, and the recording paper 5 can be transported at a high speed. The first driving motor 71 is rotated at a low speed when the first feed roller 31 is rotated. Therefore, the electric power, which is supplied to the first driving motor 71, is suppressed to be low. That is, the electric power consumption, which is required to rotate the first feed roller 31, is smaller than the electric power consumption which is required to rotate the intermediate roller pair 54. Therefore, even when the first driving motor 71 is driven to drive the first feed roller 31 during the driving of the second driving motor 72, the electric power, which can be supplied to the second driving motor 72, can be increased by an amount provided by suppressing the electric power supplied to the first driving motor 71 to be low. As a result, the main transport roller pair 55 can be rotated at a high speed.

It is desirable that the control unit 90 performs the stopping process in which the driving of the intermediate roller pair 54 is stopped, during the entire period in which the recording paper 5 is in the interposed state in which the recording paper 5 is interposed by the intermediate roller pair 54 and the main transport roller pair 55, for the following reason. That is, it is possible to maximize the stopping period of the first driving motor 71.

It is desirable that the control unit 90 stops the driving of the intermediate roller pair 54 until at least the output of the first sensor is changed from the first output to the second output after the recording paper 5 is in the interposed state as described above. The driving of the intermediate roller pair 54 is stopped until the backward end of the previously fed first recording paper 5 passes through the first sensor so that the next second recording paper 5 can be fed. Therefore, it is possible to realize both of the high speed printing and the reduction of the electric power consumption amount.

Further, it is desirable that the control unit 90 rotates the first driving motor 71 forwardly to drive the first feed roller when the output of the first sensor is changed from the first output to the second output, for the following reason. That is, it is possible to shorten the total image recording time by starting the feed of the next second recording paper 5 during the recording of the image on the previously fed first recording paper 5.

It is desirable that the control unit 90 rotates the first driving motor 71 reversely to drive the intermediate roller pair 54 when the count amount of the first counter 91 arrives at the first predetermined amount after the first driving motor 71 is rotated forwardly, for the following reason. That is, the oblique travel of the recording paper 5 can be corrected by the intermediate roller pair 54, and it is possible to enhance the accuracy of the recording position in the image recording. In particular, the oblique travel can be corrected during the period in which the recording paper 5 is allowed to wait at the intermediate roller pair 54 in the first recording mode. It is possible to enhance the accuracy of the recording position in the image recording without lowering the speed of the image recording.

It is desirable that the control unit 90 executes the pre-paper feed process in which the driving of the forward rotation of the first driving motor 71 is started to rotate the first feed roller during the interposed state of the first recording paper 5 described above, and the forward end of the next second recording paper 5 is fed to the portion of the transport passage disposed on the upstream side from the intermediate roller pair 54, for the following reason. That is, the next second recording paper 5 can be fed during the recording process for the previously fed first recording paper 5 without simultaneously driving the first transport roller 71 and the second transport roller 72. As a result, it is possible to further shorten the time required for the image recording.

Further, it is desirable that the control unit 90 rotates the first driving motor 71 forwardly to intermittently drive the first feed roller 31 during the stopping period of the main transport roller pair 55. The next second recording paper 5 can be fed during the period in which the image is recorded on the previously fed first recording paper 5 without simultaneously driving the first driving motor 71 and the second driving motor 72. As a result, it is possible to further shorten the time required for the image recording. Further, the first feed roller 71 is driven intermittently, and thus the overlapped sheets of the recording paper 5 can be reliably separated from each other.

Second Recording Mode

Figure 8A:
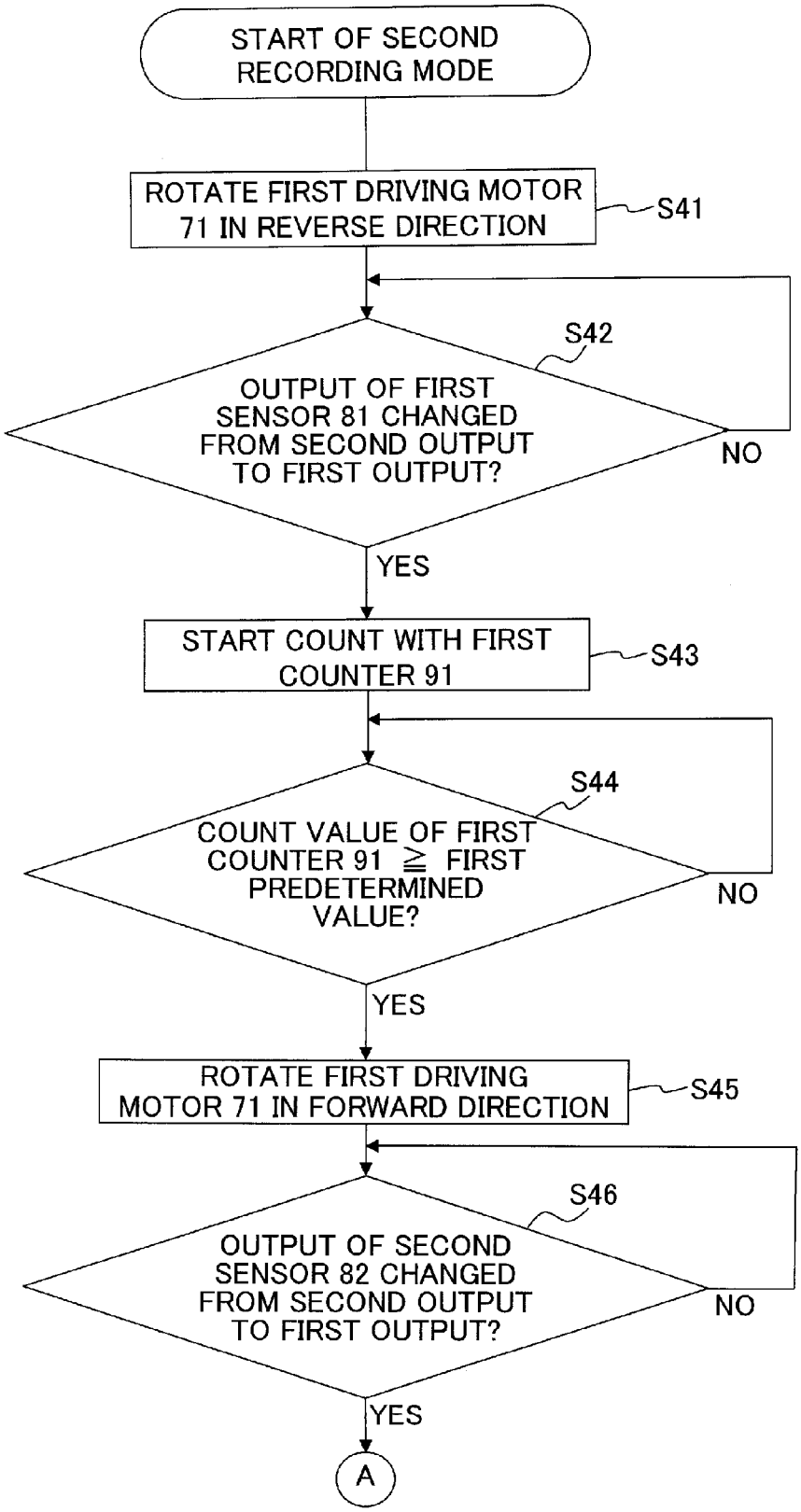
FIGS. 8A, 8B and 8C show a flow chart illustrating a second recording mode.
Figure 8B:
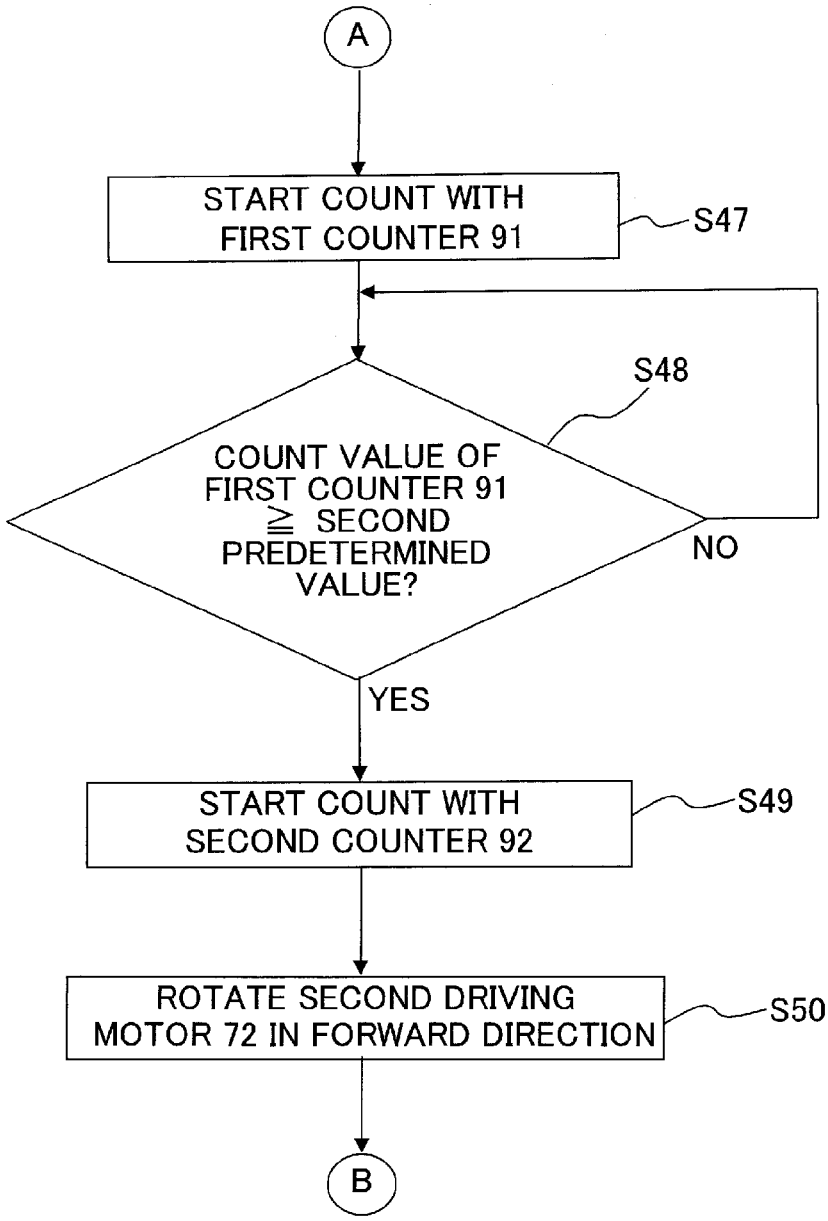
Figure 8C:
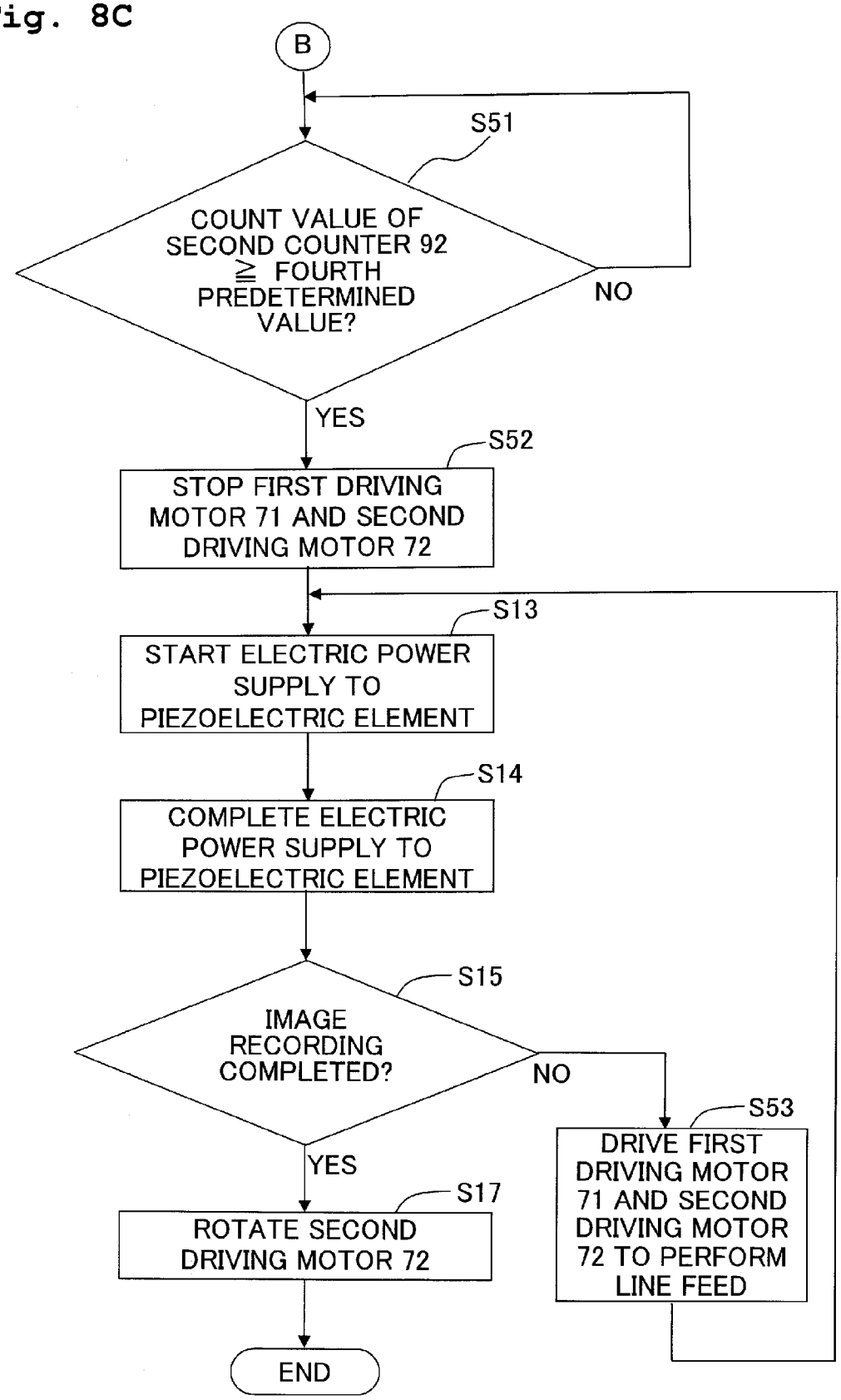

When the printing instruction is received in accordance with the second recording mode, the control unit 90 drives the third driving motor 73 to move the carriage 23. The switching gear 45 is subjected to the attitude change to the second attitude as described above to provide a state in which the second receiving gear 46B can be driven. After that, the process shown in FIG. 8 is performed.

The control unit 90 performs the registration correction by the intermediate roller pair 54 by performing the control (S41 to S47) in the same manner as the control performed in Steps S1 to S7 as described above (see FIG. 11A). Unlike Steps S1 to S7, the first driving motor 71 is rotated reversely, and the second paper feed roller 32 is driven. After that, if the control unit 90 judges that the count value obtained by the first counter 91 arrives at the second predetermined value (S48, Y), and the recording paper 5 arrives at the main transport roller pair 55 (see FIG. 11B), then the control unit 90 starts the count by the second counter 92 (S49), and the second driving motor 72 is rotated forwardly together with the first driving motor 71 (S50). That is, in the second recording mode, the registration correction is also performed by the main transport roller pair 55. Further, the transport is performed by using the both roller pairs of the intermediate roller pair 54 and the main transport roller pair 55. If the control unit 90 judges that the count value of the second counter 92 arrives at the fourth predetermined value, and the cueing is completed (S51, Y), then the first driving motor 71 and the second driving motor 72 are stopped (S52). Further, Steps S13 to S15 described above and the line feed process in Step S53 are performed. The control unit 90 drives the first driving motor 71 and the second driving motor 72 in synchronization in the line feed process in Step S53 and the cueing process in Step S50 (see FIG. 11C). That is, the intermediate roller pair 54 and the main transport roller pair 55 are rotated in synchronization. The "synchronization" means the fact that the first driving motor 71 and the second driving motor 72 are rotated in the directions in which the recording paper 5 is transported in the transport direction 38, and the first driving motor 71 and the second driving motor 72 are rotated while allowing the angular acceleration and/or the angular velocity to coincide with each other or deviating the angular acceleration and/or the angular velocity by a predetermined amount or predetermined amounts. The control unit 90 rotates the first driving motor 71 and the second driving motor 72 intermittently, and the control unit 90 allows the recording head 21 to discharge the inks during the period in which the first driving motor 71 and the second driving motor 72 is stopped. If the control unit 90 judges that the image recording is completed (S15, Y), then the second driving motor 72 is rotated forwardly, and the recording paper 5 is discharged (S17).

As explained above, in this embodiment, the intermediate roller pair 54 is provided at the curved section 51A. Accordingly, even when the radius of curvature of the curved section 51A is decreased, the recording paper 5 can be transported to the main transport roller pair 55. The compact multifunction machine 10 is realized.

The four driving sections, i.e., the first feed roller 31, the second feed roller 32, the intermediate roller pair 54, and the preserving mechanism 4 can be driven by the first driving motor 71 by the driving force transmitting/switching mechanism 40. Accordingly, it is possible to decrease the number of the driving motors to be used, and it is possible to avoid the increase in the cost.

In the first recording mode, the driving of the first driving motor 71 is stopped in the interposed state as described above. Accordingly, the electric power, which makes it possible to perform the rotation at the high speed, can be supplied from the power source unit to the second driving motor 72. Further, it is possible to reduce the electric power consumption amount. As a result, the recording paper 5 can be transported at the high speed to perform the image recording at the high speed. Further, it is possible to reduce the electric power consumption. The image recording can be performed at the higher speed by performing the pre-paper feed process as described above.

Only the second driving motor 72 is rotated at the high speed in the period in which the driving of the first driving motor 71 is stopped as described above. Therefore, it is possible to reduce the noise as compared with an arrangement in which the first driving motor 71 and the second driving motor 72 are simultaneously rotated at the high speeds. As a result, it is possible to realize the silent multifunction machine 10.

The overlapped sheets of the recording paper 5 can be reliably separated from each other by intermittently driving the first feed roller 31 or the second feed roller 32 at the slow speed in the pre-paper feed process as described above.

The first feed roller 31 is rotated by only the forward rotation of the first driving motor 71, and the second feed roller 32 is rotated by only the reverse rotation of the first driving motor 71. Therefore, even when any erroneous gear change arises, then only the intermediate roller pair 54 is rotated, and there is no fear of any erroneous feed of the recording paper 5. As a result, it is possible to avoid the erroneous paper feed which would be otherwise caused by the erroneous gear change.

The intermediate roller pair 54 can be driven by merely changing the direction of the rotation of the first driving motor 71 after feeding the recording paper 5 to the main transport passage 51. The gear change is not performed during the transport of the recording paper 5. Therefore, the multifunction machine 10 is realized, in which the paper is not jammed due to the erroneous gear change. Further, the intermediate roller pair 54 can be driven in both of the situation in which the switching gear 45 is in the first attitude and the situation in which the switching gear 45 is in the second attitude. Therefore, the image recording can be performed without changing or switching the gear with the both trays of the upper tray and the lower tray.

In the second recording mode, the intermediate roller pair 54 and the main transport roller pair 55 are driven in synchronization. Therefore, it is possible to reduce the influence which is exerted on the transport accuracy of the recording paper 5 by the frictional force generated with respect to the curved section 51A. As a result, the multifunction machine 10 is realized, which is compact and which makes it possible to perform the image recording having the high recording position accuracy. The image recording accuracy is further enhanced in the multifunction machine 10 by performing the registration correction twice in total such that the registration correction is performed at the intermediate roller pair 54 and the main transport roller pair 55 respectively in the second recording mode.

As described above, the multifunction machine 10 of this embodiment makes it possible to suppress the increase in the cost and perform the highly accurate image recording and the high speed image recording. Further, it is possible to suppress the increase in the electric power consumption amount in the high speed image recording.

Figure 14:
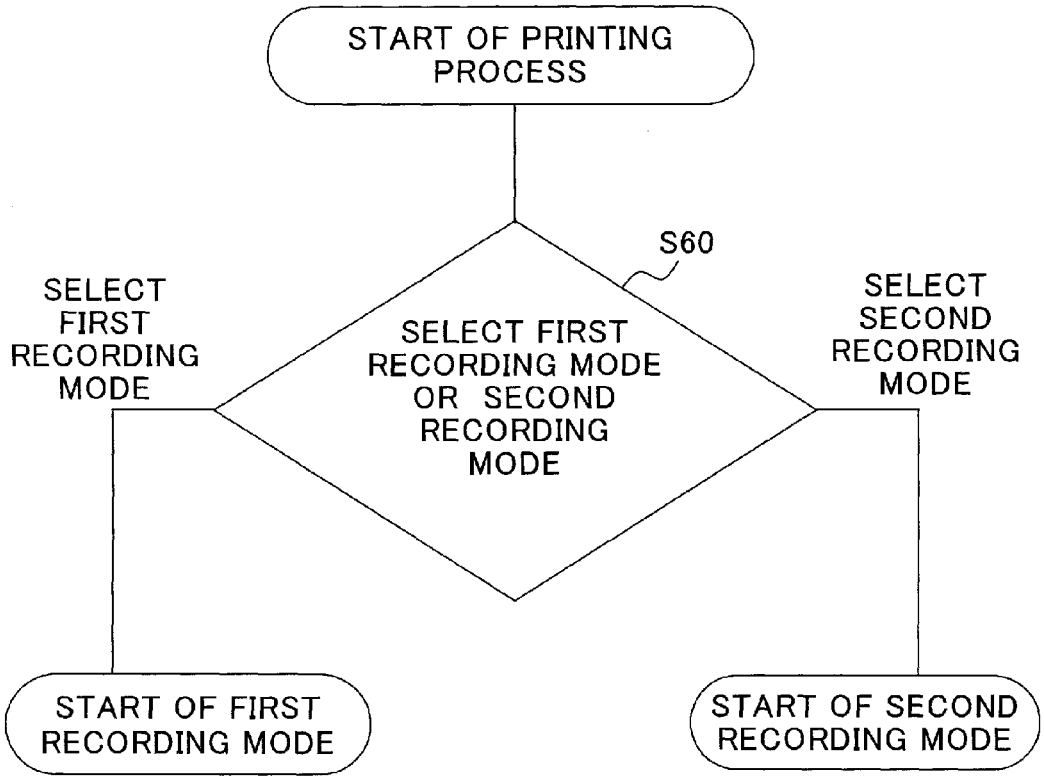
FIG. 14 shows a flow chart illustrating a selection of a recording mode.

As shown in FIG. 14, in the multifunction machine 10 of this embodiment, it is possible to appropriately select the first recording mode or the second recording mode depending on the way of use (step S60). For example, the first recording mode is selected in a case that high speed image recording is to be performed, and the second recording mode is selected in a case that highly accurate image recording is to be performed. The control unit 90 may determine whether the first recording mode or the second recording mode is executed in accordance with signal inputted from the plurality of input buttons 18 provided on the multifunction machine 10 or from the external apparatus such as a personal computer or the like. In this case, the signal may be resolution of the image to be recorded or type of the image such as text or photo. For example, the first recording mode is selected, in a case that the resolution of the image to be recorded is 300 dpi, which is lower than a predetermined value; and the second recording mode is selected, in a case that the resolution of the image is 600 dpi, which is higher than the predetermined value. Or the first recording mode is selected, in a case that the image to be recorded is text; and the second recording mode is selected, in a case that the image to be recorded is photo. Further, the control unit 90 itself may make a judgment about the resolution or the type of the image to be recorded, and determine based on the judgment whether the first recording mode or the second recording mode is executed. Alternatively, the user may select the first recording mode or the second recording mode via the plurality of input buttons 18 or via the external apparatus.

As described above, this embodiment is illustrative of the multifunction machine 10 which is capable of executing both of the first recording mode and the second recording mode. However, it is also allowable to adopt an image recording apparatus which is capable of executing only one of the first recording mode and the second recording mode.

In this embodiment, the following arrangement has been explained. That is, the image is recorded on the recording paper 5 having been placed on the upper tray 14 when the first recording mode is executed, while the image is recorded on the recording paper 5 having been placed on the lower tray 15 when the second recording mode is executed. However, it is also allowable to adopt such an arrangement that the image is recorded on the recording paper 5 having been place on the lower tray 15 when the first recording mode is executed, while the image is recorded on the recording paper 5 having been placed on the upper tray 14 when the second recording mode is executed. Alternatively, it is also allowable to adopt such an arrangement that one of the first recording mode and the second recording mode is executed by being selected by a user in relation to the both trays of the upper tray 14 and the lower tray 15.

In this embodiment, the multifunction machine 10, which performs the printing on one surface, has been explained. However, it is also allowable to adopt a multifunction machine in which the printing can be performed on the both surfaces by providing an inverting transport passage having a well-known structure.

In this embodiment, the arrangement, in which the pre-paper feed process is performed in the first recording mode, has been explained. However, it is also allowable to adopt such an arrangement that the feed of the next recording paper 5 is started after the discharge of the recording paper 5 on which the image has been recorded, without performing the pre-paper feed process.

In this embodiment, the arrangement, in which the registration correction is performed twice in the second recording mode, has been explained. However, it is also allowable to adopt such an arrangement that the registration correction is performed once by the intermediate roller pair 54 or the main transport roller pair 55.

In this embodiment, the so-called static registration or still registration has been explained, wherein the registration correction is performed in the state in which the main transport roller pair 55 is allowed to stand still, in the registration correction in relation to the main transport roller pair 55. However, the registration correction may be performed by the so-called reverse registration in which the abutment is caused against the main transport roller pair 55 having been rotated reversely.

First Modified Embodiment

The arrangement, in which the driving of the intermediate roller pair 54 is stopped after the recording paper 5 arrives at the main transport roller pair 55 in the printing process in the first recording mode, has been explained above. However, another arrangement is explained in this modified embodiment, in which the driving of the intermediate roller pair 54 is stopped after the forward end of the recording paper 5 arrives at the paper discharge roller pair 56 in the printing process.

A fifth predetermined value is stored in the storage section 94. The fifth predetermined value is the threshold value for the count value of the second counter 92. The fifth predetermined value is set as such a value that the forward end of the recording paper 5 in the transport direction 38 arrives at the paper discharge roller pair 56 if the count value of the second counter 92 arrives at the fifth predetermined value.

Figure 12A:
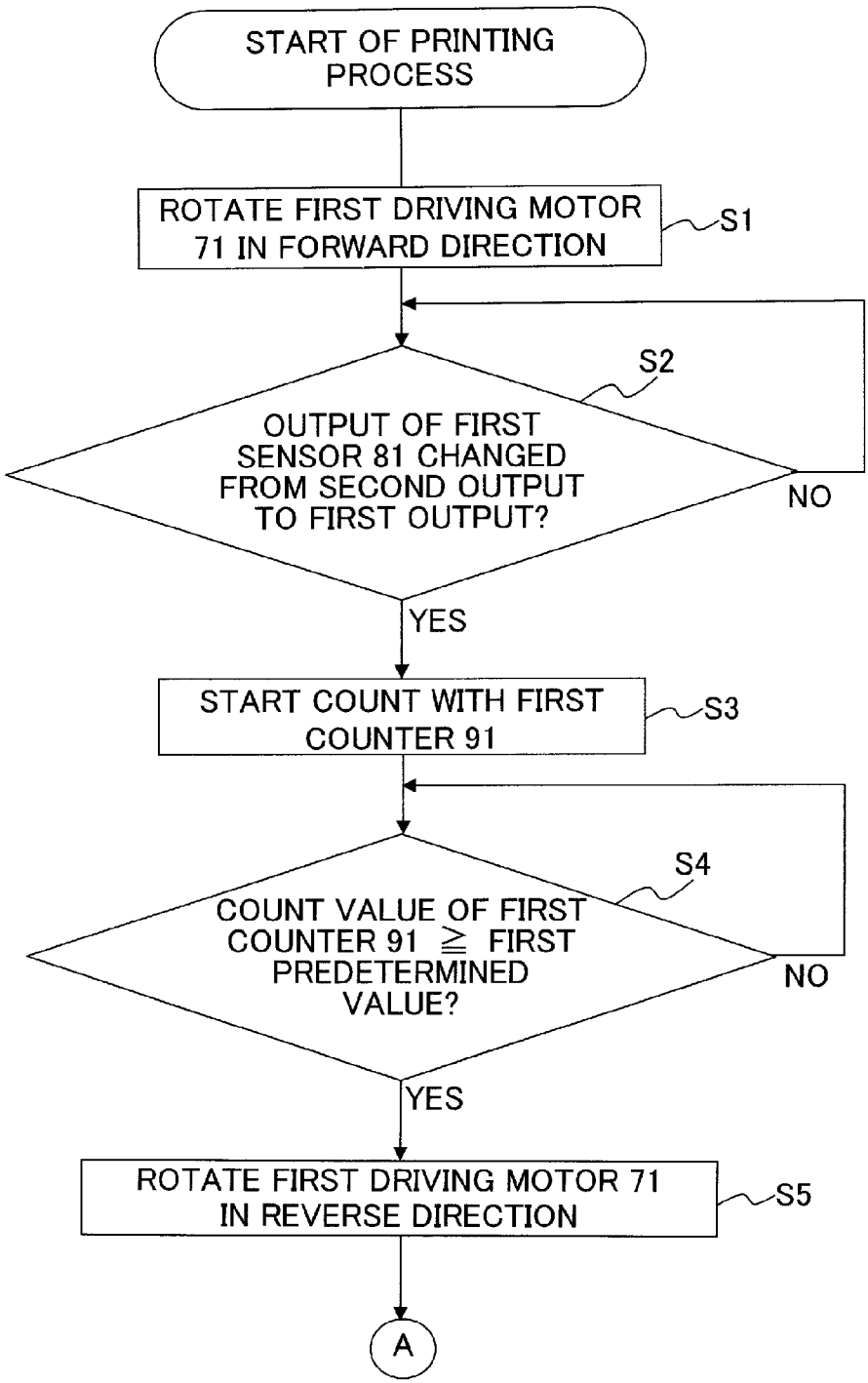
FIGS. 12A, 12B and 12C show a flow chart illustrating the printing process according to a first modified embodiment.
Figure 12B:
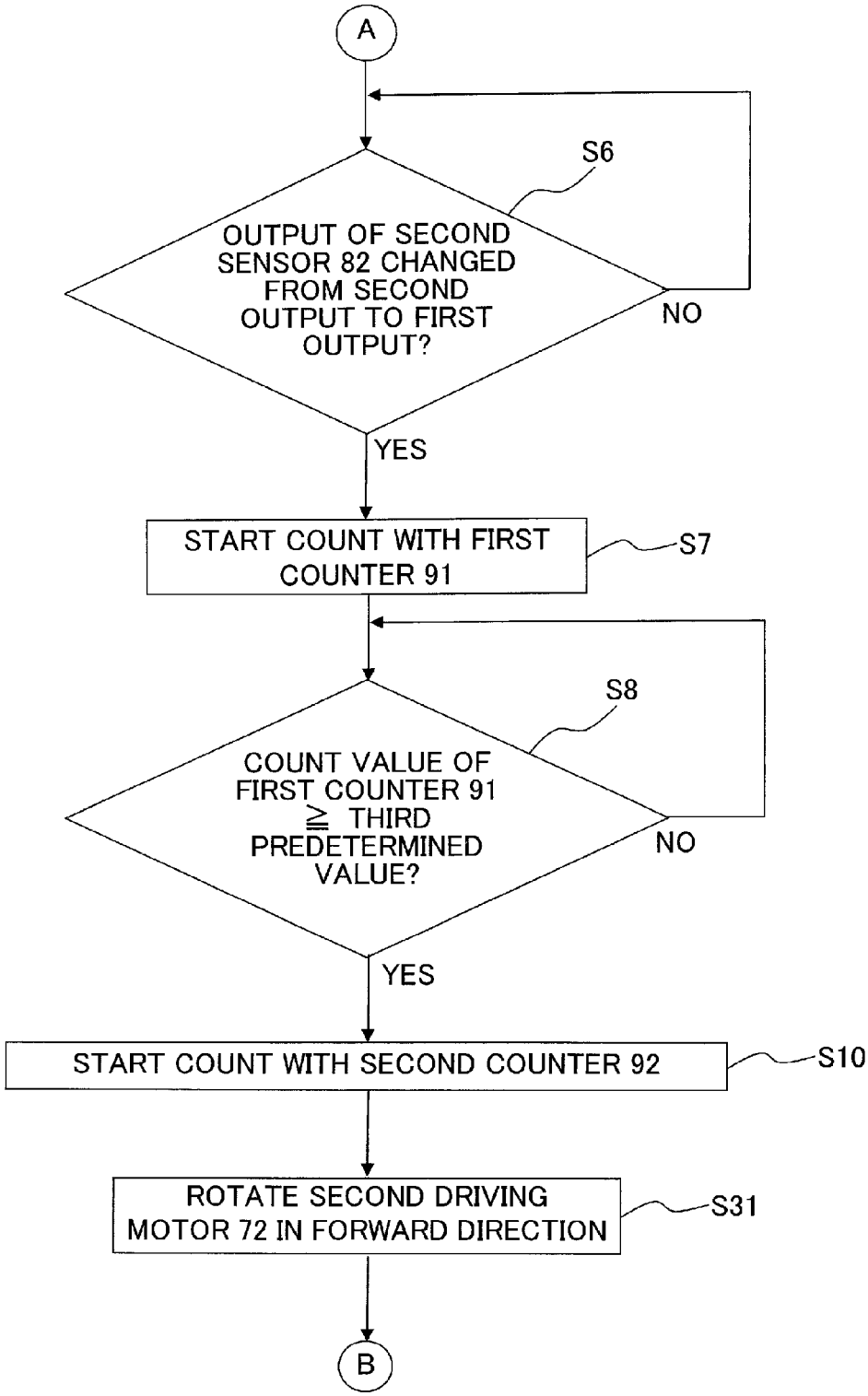
Figure 12C:
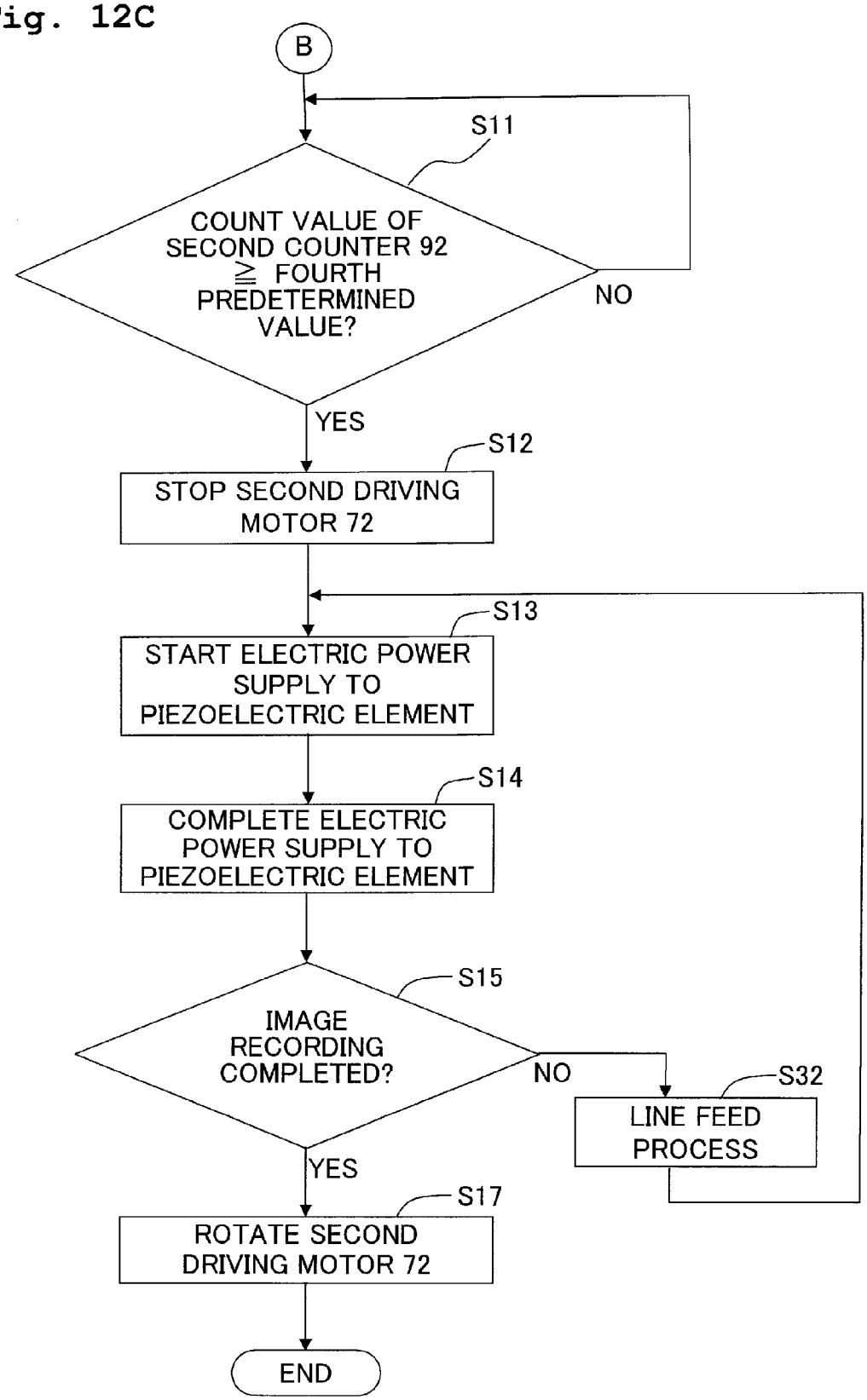

In a printing process shown in FIG. 12 as compared with the printing process shown in FIG. 6, the control unit 90 executes Step S31 in place of Step S9. In Step S31, the control unit 90 rotates the second driving motor 72 forwardly without stopping the first driving motor 71. If the control unit 90 judges that the image recording is not completed in Step S15 (S15, N), a line feed process in Step S32 is performed. In the line feed process in Step S32, the control unit 90 performs the line feed, and it is judged whether or not the forward end of the recording paper 5 arrives at the paper discharge roller pair 56 on the basis of the count value of the second counter 92 and the fifth predetermined value described above. If it is judged that the forward end of the recording paper 5 arrives at the paper discharge roller pair 56, then the reverse rotation of the first driving motor 71 is stopped, and the driving of the intermediate roller pair 54 is consequently stopped.

In this modified embodiment, the recording paper 5 is transported while being held and interposed by the intermediate roller pair 54 and the main transport roller pair 55 until the forward end of the recording paper 5 arrives at the paper discharge roller pair 56. The recording paper 5 is transported while being held and interposed by the main transport roller pair 55 and the paper discharge roller pair 56 after the forward end of the recording paper 5 arrives at the paper discharge roller pair 56. Therefore, it is possible to reduce the influence exerted on the transport accuracy of the recording paper 5 by the frictional force generated between the recording paper 5 and the curved section 51A. As a result, it is possible to enhance the accuracy of the recording position in the first recording mode as compared with the embodiment described above.

What is claimed is:

1. An image recording apparatus which records an image on a sheet-shaped recording medium, the image recording apparatus comprising:

a first placing section on which the recording medium is placed;

a transport passage via which the recording media is transported and which has a curved portion;

a first feed roller which feeds the recording medium placed on the first placing section to the transport passage;

a first transport roller pair which is disposed at the curved portion and which interposes and transports the recording medium;

a second transport roller pair which is located downstream of the first transport roller pair in a transport direction of the recording medium and which interposes and transports the recording medium;

a recording head which discharges an ink onto the recording medium transported by the second transport roller pair;

a first driving motor which is rotatable in forward and reverse directions;

a first driving force transmitting section which transmits, to the first feed roller, a driving force of the first driving motor rotating in the forward direction and which transmits, to the first transport roller pair, a driving force of the first driving motor rotating in the reverse direction;

a second driving motor which drives the second transport roller pair; and a controller which controls the first driving motor and the second driving motor, which controls the recording head to discharge the ink therefrom, and which selectively executes a first recording mode or a second recording mode, wherein the controller controls the first driving motor to transport the recording medium in the transport direction and to provide an interposed state in which the recording medium is interposed by both of the first and second transport roller pairs;

in the first recording mode, the controller stops driving of the first transport roller pair for a predetermined period of time in the interposed state to transport the recording medium by the second transport roller pair, controls the second driving motor intermittently to drive and stop the second transport roller pair and controls the recording head to discharge the ink therefrom toward the recording medium during a stopping period in which the second transport roller pair is stopped; and in the second recording mode, the controller controls the first and second driving motors in synchronization in the interposed state to transport the recording medium by the first and second transport roller pairs, controls the first and second driving motors intermittently to drive and stop the first and second transport roller pairs and controls the recording head to discharge the ink therefrom toward the recording medium during a stopping period in which the first and second transport roller pairs are stopped.

2. The image recording apparatus according to claim 1, wherein in the first recording mode, the controller stops the driving of the first transport roller pair during an entire period of the interposed state.

3. The image recording apparatus according to claim 1, further comprising a third transport roller pair which transports the recording medium on which the image has been recorded by the recording head, wherein in the first recording mode, the controller stops the driving of the first transport roller pair for the predetermined period of time under the condition that the recording medium arrives at the third transport roller pair in the interposed state.

4. The image recording apparatus according to claim 1, further comprising a first detector which is located upstream of the first transport roller pair in the transport direction, which outputs a first output during a period in which the first detector is detecting the recording medium and which outputs a second output during a period in which the first detector is not detecting the recording medium, wherein in the first recording mode, after the interposed state is provided, the controller stops the driving of the first transport roller pair at least until the output of the first detector changes from the first output to the second output.

5. The image recording apparatus according to claim 4, wherein in the first recording mode, the controller controls the first driving motor to be rotated in the forward direction to drive the first feed roller under the condition that the output of the first detector changes from the first output to the second output.

6. The image recording apparatus according to claim 4, wherein the controller includes a first counter which counts a driving amount of the first driving motor after the output of the first detector has been changed from the second output to the first output, and a storage section which stores a first predetermined amount; and the controller controls, in the first recording mode and after rotating the first driving motor in the forward direction, the first driving motor to be rotated in the reverse direction under the condition that a count amount of the first counter arrives at the first predetermined amount.

7. The image recording apparatus according to claim 6, further comprising a second detector which is located upstream of the second transport roller pair and downstream of the first transport roller pair in the transport direction, which outputs a third output during a period of time in which the second detector is detecting the recording medium and which outputs a fourth output during a period of time in which the second detector is not detecting the recording medium, wherein the controller includes a second counter which counts a driving amount of the second driving motor after the output of the second detector has been changed from the fourth output to the third output;

the storage section further stores a second predetermined amount; and the controller controls, in the second recording mode and after rotating the first driving motor in the forward direction, the first driving motor to be rotated in the reverse direction to drive the first transport roller pair under the condition that the count amount of the first counter arrives at the first predetermined amount and controls the second driving motor to drive the second transport roller pair under the condition that a count amount of the second counter arrives at the second predetermined amount.

8. The image recording apparatus according to claim 1, wherein in the first recording mode, the controller starts to control the first driving motor, in the interposed state of the recording medium, to be rotated in the forward direction to drive the first feed roller in a predetermined rotating amount so that another recording medium placed on the first placing section is fed to the transport passage and that a forward end of the another recording medium is fed to a portion, of the transport passage, disposed upstream of the first transport roller pair.

9. The image recording apparatus according to claim 1, wherein in the first recording mode, the controller controls the first driving motor to be rotated in the forward direction during the stopping period in which the second transport roller pair is stopped, so as to drive the first feed roller intermittently.

10. The image recording apparatus according to claim 1, further comprising:

a second placing section on which the recording medium is placed;

a second feed roller which feeds the recording medium placed on the second placing section to the transport passage; and a driving force transmittingswitching mechanism which transmits the driving force of the first driving motor to the first feed roller, the second feed roller, and the first transport roller pair, wherein the driving force transmittingswitching mechanism includes:

a first gear which is rotated by the first driving motor;

a second gear which has a rotary shaft along a direction of a rotary shaft of the first gear, which is movable in the direction of the rotary shaft, of which attitude is changeable between a first attitude and a second attitude in accordance with movement, and which is meshed with the first gear in both of the first and second attitudes;

a third gear which is meshed with the second gear in the first attitude;

a fourth gear which is meshed with the second gear in the second attitude;

the first driving force transmitting section which transmits rotation of the third gear, rotated by the rotation of the first driving motor in the forward direction, to the first feed roller, and which transmits rotation of the third gear, rotated by the rotation of the first driving motor in the reverse direction, to the first transport roller pair; and a second driving force transmitting section which transmits rotation of the fourth gear, rotated by the rotation of the first driving motor in the reverse direction, to the second feed roller, and which transmits the rotation of the fourth gear, rotated by the rotation of the first driving motor in the forward direction, to the first transport roller pair.

11. A control method for controlling the image recording apparatus as defined in claim 1, the control method comprising:

determining which one of the first recording mode and the second recording mode is to be executed;

driving the first feed roller by rotating the first driving motor in the forward direction to feed the recording medium, placed on the first placing section, to the transport passage;

driving the first transport roller pair by rotating the first driving motor in the reverse direction to transport the recording medium in the transport direction and to provide the interposed state;

in the first recording mode, stopping the driving of the first transport roller pair for the predetermined period of time in the interposed state, driving the second transport roller pair to transport the recording medium, driving the second driving motor intermittently to drive and stop the second transport roller pair and discharging the ink toward the recording medium during a stopping period in which the second transport roller pair is stopped; and in the second recording mode, driving the first and second driving motors in synchronization in the interposed state to transport the recording medium by the first and second transport roller pairs, driving the first and second driving motors intermittently to drive and stop the first and second transport roller pairs and discharging the ink toward the recording medium during a stopping period in which the first and second transport roller pairs are stopped.

* * * * *